US011193321B2

(12) United States Patent
Van Camp et al.

(10) Patent No.: US 11,193,321 B2
(45) Date of Patent: Dec. 7, 2021

(54) DOOR ENTRYWAY SYSTEM

(71) Applicant: Endura Products, Inc., Colfax, NC (US)

(72) Inventors: Brent Van Camp, Kernersville, NC (US); Bruce Procton, Greensboro, NC (US)

(73) Assignee: Endura Products, LLC, Colfax, NC (US)

( * ) Notice: Subject to any disclaimer, the term of this patent is extended or adjusted under 35 U.S.C. 154(b) by 187 days.

(21) Appl. No.: 16/561,359

(22) Filed: Sep. 5, 2019

(65) Prior Publication Data

US 2019/0390505 A1 Dec. 26, 2019

Related U.S. Application Data

(63) Continuation of application No. 16/057,894, filed on Aug. 8, 2018, now Pat. No. 10,407,975, which is a (Continued)

(51) Int. Cl.
*E06B 1/70* (2006.01)
*E06B 7/18* (2006.01)
(Continued)

(52) U.S. Cl.
CPC ..... *E06B 1/70* (2013.01); *E06B 7/14* (2013.01); *E06B 7/18* (2013.01); *E06B 7/205* (2013.01);
(Continued)

(58) Field of Classification Search
CPC ..... E06B 1/70; E06B 7/18; E06B 7/14; E06B 7/205; E06B 7/2316; E06B 7/232; E06B 2001/707
See application file for complete search history.

(56) References Cited

U.S. PATENT DOCUMENTS 56,046 A 7/1866 Hawkins
126,014 A 4/1872 Brown et al.
(Continued)

FOREIGN PATENT DOCUMENTS

CN 3480288 10/2005
DE 2135919 A1 7/1971
(Continued)

OTHER PUBLICATIONS

AFCO Industries, Inc., Millwork Products Catalogue, pp. cover page, 6 (vinyl cap) and 9 (riser), Believed available as of 2012, 52 pgs.
(Continued)

*Primary Examiner* — Justin B Rephann
(74) *Attorney, Agent, or Firm* — Womble Bond Dickinson (US) LLP

(57) ABSTRACT

A threshold includes a substantially vertically upstanding nosing extending along a longitudinal axis of the threshold and a substantially vertically upstanding dam spaced from and substantially parallel to the upstanding nosing. A threshold cap is disposed at least partially across a gap between the upstanding nosing and the upstanding dam. A support, which supports the threshold cap, is located at least partially within the gap. The threshold cap is adjustable between at least a raised position and a lowered position. The threshold cap is biased toward the raised position when the door panel of the entryway is in an open position. The threshold cap pivots about a pivot axis parallel with the longitudinal axis. The pivot axis is not a central axis of the threshold cap.

19 Claims, 28 Drawing Sheets

Related U.S. Application Data continuation of application No. 15/158,706, filed on May 19, 2016, now Pat. No. 10,066,433, which is a continuation of application No. 14/666,366, filed on Mar. 24, 2015, now Pat. No. 9,371,682, which is a continuation of application No. 13/835,874, filed on Mar. 15, 2013, now Pat. No. 8,991,100, which is a continuation-in-part of application No. 13/215,905, filed on Aug. 23, 2011, now Pat. No. 8,522,483.

(51) Int. Cl.

| | |
|---|---|
| ***E06B 7/205*** | (2006.01) |
| ***E06B 7/14*** | (2006.01) |
| ***E06B 7/23*** | (2006.01) |
| ***E06B 7/232*** | (2006.01) |

(52) U.S. Cl.

CPC ..... *E06B 7/232* (2013.01); *E06B 7/2316* (2013.01); *E06B 2001/707* (2013.01)

(56) References Cited

U.S. PATENT DOCUMENTS

| | | | |
|---|---|---|---|
| 220,460 | A | 10/1879 | York |
| 313,742 | A | 3/1885 | Kintner |
| 394,864 | A | 12/1888 | Lathrop |
| 435,658 | A | 9/1890 | Brennaman |
| 500,885 | A | 7/1893 | Green et al. |
| 582,451 | A | 5/1897 | Brandon |
| 600,301 | A | 3/1898 | Barger |
| 618,013 | A | 1/1899 | Roeder |
| 628,278 | A | 7/1899 | Mitsch |
| 704,295 | A | 7/1902 | Sowden |
| 1,210,535 | A | 1/1917 | Riley |
| 1,468,958 | A | 9/1923 | Champion |
| 1,595,827 | A | 8/1926 | Fisque |
| 1,795,853 | A | 3/1931 | Glass |
| 1,883,609 | A | 10/1932 | Dennis |
| 1,993,506 | A | 3/1935 | Fauner |
| 2,022,408 | A | 11/1935 | Dahl |
| 2,108,137 | A | 2/1938 | Oftedal et al. |
| 2,129,381 | A | 9/1938 | Oftedal et al. |
| 2,202,482 | A | 5/1940 | Dahl |
| 2,293,292 | A | 8/1942 | Goeliner |
| 2,579,875 | A | 12/1951 | Stanko |
| 2,630,891 | A | 3/1953 | Zitomer |
| 2,663,056 | A | 12/1953 | Hardgrove |
| 2,696,029 | A | 12/1954 | Neff |
| 2,718,677 | A | 9/1955 | Cornell |
| 2,728,118 | A | 12/1955 | Gossen |
| 2,818,614 | A | 1/1958 | Lapka, Jr. |
| 2,853,749 | A | 9/1958 | West |
| 2,949,651 | A | 8/1960 | Hill |
| 3,083,420 | A | 4/1963 | Tinflow |
| 3,114,180 | A | 12/1963 | Riedl |
| 3,250,040 | A | 5/1966 | Squires |
| 3,273,287 | A | 9/1966 | Pease, Jr. |
| 3,374,579 | A | 3/1968 | Neff |
| 3,378,958 | A | 4/1968 | Parks et al. |
| 3,402,512 | A | 9/1968 | Peterson |
| 3,432,966 | A | 3/1969 | Bordner |
| 3,448,543 | A | 6/1969 | Multer |
| 3,475,866 | A | 11/1969 | Johansen |
| 3,521,404 | A | 7/1970 | Hager et al. |
| 3,690,037 | A | 9/1972 | Kempel |
| 3,762,100 | A | 10/1973 | Kempel |
| 3,854,246 | A | 12/1974 | McAllister |
| 3,900,967 | A | 8/1975 | Bursk et al. |
| 3,962,828 | A | 6/1976 | McAllister |
| 3,967,412 | A | 7/1976 | Governale |
| 4,003,162 | A | 1/1977 | Britt |
| 4,034,511 | A | 7/1977 | Bursk |
| 4,055,917 | A | 11/1977 | Coller |
| 4,073,093 | A | 2/1978 | Ookawa et al. |
| 4,074,464 | A | 2/1978 | McCay |
| 4,079,550 | A | 3/1978 | Bursk et al. |
| 4,104,830 | A | 8/1978 | Eagle |
| 4,114,319 | A | 9/1978 | Governale |
| 4,146,995 | A | 4/1979 | Britt |
| 4,156,325 | A | 5/1979 | McMullen et al. |
| 4,185,417 | A | 1/1980 | McKann |
| 4,213,275 | A | 7/1980 | Oehmig |
| 4,224,766 | A | 9/1980 | Procton |
| 4,287,684 | A | 9/1981 | McKann |
| 4,310,991 | A | 1/1982 | Seely |
| 4,352,258 | A | 10/1982 | Bursk et al. |
| 4,387,535 | A | 6/1983 | Corbo |
| D270,185 | S | 8/1983 | Wooten et al. |
| 4,411,104 | A | 10/1983 | St. Aubin |
| 4,447,987 | A | 5/1984 | Lesosky |
| 4,447,989 | A | 5/1984 | Mailand et al. |
| 4,513,536 | A | 4/1985 | Giguere |
| D279,409 | S | 6/1985 | Allen, Jr. |
| 4,525,953 | A | 7/1985 | Stutzman |
| 4,565,033 | A | 1/1986 | Tinfow |
| 4,625,457 | A | 12/1986 | Avery |
| 4,628,639 | A | 12/1986 | Lownsdale |
| 4,686,793 | A | 8/1987 | Mills |
| 4,716,683 | A | 1/1988 | Minter |
| 4,831,779 | A | 5/1989 | Kehrli et al. |
| 5,010,690 | A | 4/1991 | Geoffrey |
| 5,012,614 | A | 5/1991 | Shea |
| 5,018,307 | A | 5/1991 | Burrous et al. |
| 5,056,263 | A | 10/1991 | Bies |
| 5,067,279 | A | 11/1991 | Hagemeyer |
| 5,136,814 | A | 8/1992 | Headrick |
| 5,150,544 | A | 9/1992 | Burnett |
| 5,174,065 | A | 12/1992 | Schlicht |
| 5,179,804 | A | 1/1993 | Young |
| 5,214,880 | A | 6/1993 | Woodruff et al. |
| 5,230,181 | A | 7/1993 | Geoffrey et al. |
| D354,572 | S | 1/1995 | Headrick |
| 5,426,894 | A | 6/1995 | Headrick |
| 5,475,946 | A | 12/1995 | Howe |
| 5,588,266 | A | 12/1996 | Headrick |
| 5,592,782 | A | 1/1997 | Scott |
| 5,638,641 | A | 6/1997 | Joffe et al. |
| 5,675,935 | A | 10/1997 | Lin |
| 5,706,607 | A | 1/1998 | Frey |
| 5,857,291 | A | 1/1999 | Headrick |
| 5,887,392 | A | 3/1999 | Martin |
| 5,943,825 | A | 8/1999 | Procton et al. |
| 6,006,375 | A | 12/1999 | Carr |
| 6,052,949 | A | 4/2000 | Procton et al. |
| 6,061,967 | A | 5/2000 | Judds |
| 6,125,584 | A | 10/2000 | Sanders |
| 6,138,413 | A | 10/2000 | Fehr |
| 6,216,395 | B1 | 4/2001 | Kelly |
| 6,345,477 | B1 | 2/2002 | Kepler et al. |
| 6,367,201 | B1 | 4/2002 | Massey et al. |
| 6,371,188 | B1 | 4/2002 | Baczuk et al. |
| 6,374,545 | B1 | 4/2002 | Baczuk |
| 6,484,446 | B2 | 11/2002 | Young |
| D488,243 | S | 4/2004 | Babka et al. |
| 6,763,639 | B2 | 7/2004 | Bennett et al. |
| 6,789,358 | B2 | 9/2004 | Procton et al. |
| 7,114,293 | B2 | 10/2006 | Purlee |
| 7,140,154 | B2 | 11/2006 | Governale et al. |
| D549,850 | S | 8/2007 | Perlman |
| 7,263,808 | B2 | 9/2007 | Massey et al. |
| 7,350,336 | B2 | 4/2008 | Bennett |
| 7,389,611 | B2 | 6/2008 | Palenske CI |
| 7,472,516 | B2 | 1/2009 | Pepper et al. |
| 7,600,346 | B2 | 10/2009 | Meeks |
| 7,644,539 | B2 | 1/2010 | Baxter |
| 7,669,369 | B2 | 3/2010 | Henry et al. |
| 7,694,471 | B2 | 4/2010 | Meeks et al. |
| 7,788,863 | B2 | 9/2010 | Pepper et al. |
| D627,488 | S | 11/2010 | Abdollahzadeh et al. |
| 7,878,559 | B2 | 2/2011 | Meeks et al. |
| D638,958 | S | 5/2011 | Van Camp et al. |
| 8,074,699 | B2 | 12/2011 | Jones et al. |
| 8,371,069 | B2 | 2/2013 | O'Sullivan et al. |

(56) References Cited

U.S. PATENT DOCUMENTS

| | | | |
|---|---|---|---|
| 8,375,659 | B2 | 2/2013 | Bogenhagen et al. |
| 8,413,383 | B2 | 4/2013 | Van Camp et al. |
| 8,522,483 | B2 | 9/2013 | Van Camp et al. |
| D696,794 | S | 12/2013 | Mossman |
| D696,795 | S | 12/2013 | Mossman |
| 8,726,575 | B1 | 5/2014 | Vulpitta et al. |
| 8,813,427 | B2 | 8/2014 | Meeks |
| D713,976 | S | 9/2014 | Van Camp |
| 8,875,443 | B2 | 11/2014 | Siegel |
| D722,387 | S | 2/2015 | Van Camp |
| D722,388 | S | 2/2015 | Van Camp |
| 8,991,100 | B2 | 3/2015 | Van Camp et al. |
| 8,991,101 | B2 | 3/2015 | Van Camp et al. |
| 9,068,355 | B1 | 6/2015 | Ksiezopolski |
| D733,927 | S | 7/2015 | Van Camp |
| D748,284 | S | 1/2016 | Boer |
| 9,316,041 | B2 | 4/2016 | Olson et al. |
| 9,371,682 | B2 | 6/2016 | Van Camp et al. |
| 9,487,992 | B2 | 11/2016 | Meeks |
| 9,528,314 | B2 | 12/2016 | Mitchell et al. |
| 10,066,433 | B2 | 9/2018 | Van Camp et al. |
| 10,407,975 | B2 | 9/2019 | Van Camp et al. |
| 2002/0194787 | A1 | 12/2002 | Bennett |
| 2003/0005644 | A1 | 1/2003 | Reithmeyer et al. |
| 2004/0139667 | A1 | 7/2004 | Massey et al. |
| 2004/0200153 | A1 | 10/2004 | Khanlarian |
| 2005/0198911 | A1 | 9/2005 | Baczuk et al. |
| 2005/0210754 | A1 | 9/2005 | Ferrell |
| 2005/0223647 | A1 | 10/2005 | Stutzman et al. |
| 2006/0053695 | A1 | 3/2006 | Palenske |
| 2006/0174545 | A1 | 8/2006 | Young |
| 2006/0283087 | A1 | 12/2006 | Baxter |
| 2006/0283090 | A1 | 12/2006 | Moody |
| 2007/0227076 | A1 | 10/2007 | Braun |
| 2007/0261312 | A1 | 11/2007 | Kuppler |
| 2008/0110100 | A1 | 5/2008 | Heppner |
| 2008/0229669 | A1 | 9/2008 | Abdollahzadeh et al. |
| 2009/0199486 | A1 | 8/2009 | Wernlund et al. |
| 2010/0107503 | A1 | 5/2010 | Chapman |
| 2010/0192469 | A1 | 8/2010 | McDaniel |
| 2010/0242393 | A1 | 9/2010 | Kornfalt |
| 2010/0257789 | A1 | 10/2010 | Meeks |
| 2012/0079771 | A1 | 4/2012 | Meulemans |
| 2012/0324817 | A1 | 12/2012 | Stanchfield |
| 2013/0047518 | A1 | 2/2013 | Van Camp et al. |
| 2013/0199100 | A1 | 8/2013 | Van Camp et al. |
| 2013/0276376 | A1 | 10/2013 | Gilbert et al. |
| 2016/0145931 | A1 | 5/2016 | Meeks |

FOREIGN PATENT DOCUMENTS

| | | | |
|---|---|---|---|
| DE | 19932332 | C2 | 10/2003 |
| EP | 327840 | A2 | 6/1989 |
| FR | 945217 | A | 4/1947 |
| GB | 1898/09868 | A | 3/1899 |
| GB | 411361 | A | 6/1934 |
| JP | 1986085690 | | 6/1986 |
| JP | 06026276 | A | 2/1994 |
| JP | 10037626 | A | 2/1998 |
| JP | 10102937 | A | 4/1998 |
| JP | 1998110579 | | 4/1998 |
| JP | 2003/013672 | A | 1/2003 |
| JP | 2005/023628 | A | 1/2005 |
| KR | 10094929 | B1 | 6/2006 |

OTHER PUBLICATIONS

American Architectural Manufacturers Association, AAMA AG-11 AAMA Glossary, believed to be available as of 2011, pp. 50 ("threshold"), 54 ("weatherstrip"), (http://www.aamanet.org/general/1/241/skylight-glossary-of-terms, accessed on Mar. 20, 2013), 58 pgs.

Association of Millwork Distributors, Millwork Principles and Practices, believed to be available as of 2010, pp. cover page, 130 (door sill), 131 (threshold), 160 (adjustable sill), 162 (weatherstrip), 6 pgs.

Combo Aluminum Products, 50th Anniversary Catalog, believed to be available 2008, cover page, pp. 1, 28.(hardwood cap), 31 (composite cap), 45 (foam weather-strip), (http://www.comboaluminum.com/Catalog/Combo_Aluminum_Catalog.pdf, accessed Mar. 20, 2013), 59 pgs.

Endura Products, Glossary, 7 pages ("Cep/Riser", "Sill", "Weatherstrip"), available as of Aug. 22, 2011 (http://www.enduraproducts.com/technical-info/glossary.aspx, accessed Mar. 20, 2013).

Official Action of U.S. Appl. No. 13/215,905, dated Feb. 15, 2013, 21 pgs.

Official Action of U.S. Appl. No. 13/215,905, dated Nov. 14, 2012, 18 pgs.

Profile Selection Guide Buliding Products Division, Schlegel Systems, Inc., believed to be available as of Jun. 2006, page entitled T-Slot APTUS® TPE Weatherseals, 3 pgs.

ThermaTru Doors Product Manual, Comp 13, Comp11, Jan. 2011 (online). Designs shown therein known at least as early as Aug. 24, 2010. Retrieved on Mar. 3, 2011: <URL: www.thermatru.com/customer-support/technical-manuals/ArchComplComp-12-14.pdf &gf;; <URL: http://www.thermatru.com/customer-support/technical-manuals/manuals/ArchComp/Comp11.pdf>, 6 pgs.

ThermaTru Doors Product Manual, Comp 13, Kerf Door Bottom, Jun. 2005, 2 pgs.

ThermaTru Doors, Sills Product Manual, Comp 11, Selft-Adjusting Thermal Break Sill, Jun. 2005, 4 pgs.

Window & Door Manufacturers Association, The Door Glossary, AAMA/WDMA/CSA 101/I.S.2/A440-11, NAFS—North American Fenestration Standard/Specification for Windows, Doors, and Skylights, believed to be available 2011, (https://www.wdma.com/TechnicalCenter/TheDoorGlossary/tabid/64/Default.aspx, accessed on Mar. 20, 2013), 9 pgs.

Window & Door Manufacturers Association, The Window Glossary, AAMA/WDMA/CSA 101/I.S.2/A440-11, NAFS—North American Fenestration Standard/Specification for Windows, Doors, and Skylights, believed to be available 2011, (https://www.wdma.comTechnicalCenter/TheWndowGlossary/tabid/109/Default.aspx, accessed on Mar. 18, 2013), 11 pgs.

DOOR ENTRYWAY SYSTEM

PRIORITY

This application is a continuation of application Ser. No. 16/057,894, filed Aug. 8, 2018, which is a continuation of application Ser. No. 15/158,706, filed May 19, 2016 (now U.S. Pat. No. 10,066,433), which is a continuation of application Ser. No. 14/666,366, filed on Mar. 24, 2015 (now U.S. Pat. No. 9,371,682), which is a continuation of application Ser. No. 13/835,874, filed on Mar. 15, 2013 (now U.S. Pat. No. 8,991,100), which is a continuation-in-part of application Ser. No. 13/215,905, filed on Aug. 23, 2011 (now U.S. Pat. No. 8,522,483), the contents of the applications as-filed, which are incorporated herein by reference.

TECHNICAL FIELD

The present disclosure relates generally to entryway systems for residential and commercial buildings and more particularly to threshold assemblies of entryway systems.

BACKGROUND OF THE DISCLOSURE

Entryway systems used in building construction generally include a pair of vertically extending door jambs and a head jamb that frame the entryway and receive a hinged door panel. An elongated threshold assembly is attached at its ends to the bottoms of the door jambs and spans the bottom of the entryway. Many modern threshold assemblies include a frame defining an upwardly-open channel from which a sill slopes outwardly and downwardly. A threshold cap is disposed in the upwardly open channel and underlies a closed door mounted in the entryway. The threshold cap usually is manually adjustable (using, for example, screw mechanisms) in a vertical direction to engage and form a seal with the bottom of the door panel or a flexible sweep attached thereto.

For years, manufacturers of threshold assemblies for entryway systems have struggled with preventing the leakage of incidental rain water beneath the threshold, in order to avoid rainwater causing rot to the underlying sub floor. One location where such incidental leakage is a problem is between the threshold cap and the underside of a door panel or door sweep. In this regard, houses can settle after construction, thus compromising the weathersealing of the door panel due to movement of the mating components from their intended position. Homeowners must then be able to vertically adjust the threshold cap manually in order to correct this issue, which can be difficult to properly achieve. Furthermore, cap plugs used to address these issues placed in adjustment hardware holes can interfere with the sealing of the threshold cap to the underside (e.g., the bottom of the door) of the door panel.

Another location where such incidental leakage is a problem is along the gap between a forward wall of the upwardly open channel of the frame and the threshold cap that rides in the channel. This region poses a particular leakage problem because it is exposed to the elements on the outside of the entryway and, in a blowing rain for example, rainwater can be forced by several hydrodynamic mechanisms into the gap. When this happens, water can collect in the channel under the threshold cap, from where it flows to the ends of the threshold assembly and onto the sub floor below.

A variety of attempts to stem leakage along the gap between the threshold cap and its channel have been made over the years. For example, some threshold assemblies include an upstanding dam that forms the upper part of the outside channel wall. It is also common where plastic threshold caps are used to form the threshold cap with an overlapping tongue along its outside edge that overlaps the dam to prevent leakage of rainwater from the top of the threshold cap directly into the gap between the forward edge of the cap and its channel.

The various techniques used in the past to seal the gap between a threshold cap and its channel have generally been less than successful. For example, flexible bellows-type seals tend to harden, shrink and crack over time, allowing water to seep directly through the bellows and into the channel. Where flexible fins are used to create the seal, dirt can accumulate between the fin and the surface of the threshold cap, breaking the seal. In addition, in cases where the entryway system may not be installed on a perfectly level surface, the threshold assembly can be racked to the extent that the fin separates from the threshold cap, resulting in severe leaks and an unsightly appearance. The seal also can be affected by the natural differential thermal expansion and contraction experienced by the various different materials of the assembly. Even with plastic threshold caps with dams and overlapping tongues, leakage still can occur due to the capillary effect between the tongues and the dams.

Accordingly, a need exists for an entryway system that includes a door entryway system and threshold assembly that improves management of water, both incidental and non-incidental, entering the threshold assembly.

BRIEF SUMMARY OF THE DISCLOSURE

In one embodiment, a door entryway system can include a door sweep capable of attachment to a bottom of a door panel. The door entryway system can also include a threshold assembly having a self-articulating threshold cap configured to be biased toward the door sweep and interact therewith to form a sealing barrier when the door panel is in a closed position.

The door entryway system can also include a threshold assembly that can be configured to sealingly interact with the door sweep. The threshold assembly can include a threshold substrate having a nosing defining one side of an open-ended sill channel. Also included in the threshold assembly is a self-articulating threshold cap that can be received within the open-ended sill channel. The self-articulating threshold cap can be configured to be biased toward the door sweep and interact therewith to form a sealing barrier when the door panel is in a closed position. A nosing strip also can be secured to the nosing and configured to sealingly engage the self-articulating threshold cap.

An additional embodiment of a door entryway system can include a door sweep capable of being attached to a bottom of a door panel and a threshold assembly configured to sealingly interact with the door sweep. The threshold assembly can include a threshold substrate defining an open-ended sill channel, and further comprising a threshold cap disposed within the sill channel. The threshold assembly can also include a self-articulating means for maintaining a sealing barrier between the door sweep and the threshold cap when the door panel is in a closed position.

An additional embodiment of a door entryway system can include a door sweep capable of being attached to a bottom of a door panel. The door entryway system can also include a threshold assembly having a self-articulating threshold cap configured to be biased toward the door sweep and interact therewith to form a sealing barrier when the door panel is in a closed position. The self-articulating threshold cap can include a rigid articulating top portion and at least one support base, preferably at least a support base disposed at each end of the rigid articulating top portion. The support bases can be disposed within an upwardly open sill channel defined by a threshold substrate or nosing.

Another embodiment of the invention is a threshold assembly for a door entryway system of a building structure. The threshold assembly can include a threshold substrate having a forward end adapted to be disposed exterior to a building structure. The forward end can include at least one drain hole configured to allow water to exit the threshold substrate. In addition, the threshold assembly can include at least one air inlet configured to allow air to enter the threshold substrate. The air inlet can be separate from the drain hole. Further, the air inlet can be in an elevated arrangement with respect to the drain hole such that water exits the threshold substrate through the at least one drain hole.

In the embodiment of the threshold assembly for a door entryway described above, the forward end of the threshold substrate can optionally include a forward edge with the drain hole and the air inlet can be at least partially defined by the forward edge.

In the embodiment of the threshold assembly for a door entryway described above, the forward edge of the threshold substrate can optionally define a pair of drain holes positioned at opposing ends thereof. In such an embodiment, a plurality of the air inlets can be disposed between the pair of drain holes along the forward edge.

In the embodiment of the threshold assembly for a door entryway described above, the forward edge can define a recess forming the one or more air inlets.

In the embodiment of the threshold assembly for a door entryway described above, the forward edge can optionally include a wall extending substantially perpendicular to a floor of the threshold substrate. In addition, the forward edge can optionally include a lip extending substantially perpendicular from the wall. The forward edge can define a recess extending from the wall and about the lip to form an air inlet.

In the embodiment of the threshold assembly for a door entryway described above, optionally included thereon is a decking cover plate configured to extend about the threshold substrate to form an upper surface thereof. The decking cover plate can extend about the lip so as to cooperate with the forward edge to form the at least one air inlet.

In the embodiment of the threshold assembly for a door entryway described above, the forward edge can include a top surface defining a recess. The decking cover plate can extend about the threshold substrate to form an upper surface thereof. The optionally decking cover plate can be in abutting contact with the top surface of the forward edge to enclose the recess so as to cooperate therewith to form the at least one air inlet.

In the embodiment of the threshold assembly for a door entryway described above, the threshold substrate is constructed from an injection molded plastic material. Other materials can be used to form the threshold substrate.

An additional, second embodiment of a threshold assembly for a door entryway system can include a threshold substrate having a nosing defining one side of an open-ended sill channel. The threshold substrate can also include a self-articulating threshold cap received within the open-ended sill channel. The self-articulating threshold cap can be configured to be biased toward one of a door panel and a door sweep and being capable of interacting therewith so as to form a sealing barrier therebetween when the door panel is in a closed position. In addition, a nosing strip can be secured to the nosing and is configured to sealingly engage the self-articulating threshold cap. Optionally, the nosing strip can include a resilient fin configured to sealingly engage the self-articulating threshold cap.

In the second embodiment of the threshold assembly described above, the self-articulating threshold cap can optionally include a rigid top articulating portion having a top wall and a locking wall extending substantially perpendicularly from the top wall. The resilient fin can interact with the locking wall to form a sealing barrier along a length of the threshold substrate.

In the second embodiment of the threshold assembly described above, the self-articulating threshold cap can further optionally include a bottom support wall disposed adjacent to a floor of the sill channel. The self-articulating threshold cap can have a rear wall operably engaged with and extending substantially perpendicularly from the bottom support wall so as to be substantially parallel with an inside surface of the nosing. Further, the rear wall can have a projection configured to interact with the nosing strip to form a sealing barrier.

In the second embodiment of the threshold assembly described above, optionally included therein is a biasing mechanism configured to interact with the threshold cap and to bias the threshold cap against the door sweep when the door panel is in the closed position. The biasing mechanism can be disposed within a cavity defined by the threshold cap.

In the second embodiment of the threshold assembly described above, the threshold cap can optionally include a rigid articulating top portion capable of being deflected by the door panel or door sweep when the door panel is moved toward the closed position. The articulating top portion of the threshold cap is capable of biasing toward the door panel or the door sweep when the door panel is in the closed position.

In the second embodiment of the threshold assembly described above, the threshold cap is optionally an integrally-formed and unitary workpiece constructed from, for example, a polymer material.

In the second embodiment of the threshold assembly described above, the threshold cap can include a bottom support wall capable of engaging a floor of the sill channel, a front wall operably engaged with the bottom support wall, a rigid articulating top portion extending from the front wall, a rear wall operably engaged with the bottom support wall, and an intermediate wall extending from the bottom support wall. The rigid top articulating portion can include a top wall and a locking wall extending substantially perpendicularly from the top wall. The locking wall can extend between the rear wall and intermediate wall. The locking wall can have a hook portion configured to interact with the intermediate wall to prevent the locking wall from entirely advancing therepast.

In the second embodiment of the threshold assembly described above, the threshold substrate is optionally constructed from an injection molded plastic material.

Yet another embodiment of the invention is a threshold cap capable of being received within a sill channel of a threshold assembly for a door entryway. The threshold cap can include a bottom support wall capable of engaging a floor of the sill channel. A front wall can be operably engaged with the bottom support wall and has at least a portion thereof being substantially perpendicular to the bottom support wall. The threshold cap can also include a rigid articulating top portion extending from the front wall.

The articulating top portion can be configured to bias against one of a door sweep mounted to a door panel when the door panel is in a closed position.

In the embodiment of the threshold cap describe above, the rigid articulating top portion can be biased upwardly toward the door sweep by a resilient hinge disposed between the articulating top portion and the front wall.

In the embodiment of the threshold cap described above, optionally included is a dam sealing projection extending from the front wall in a direction opposite to the rigid articulating top portion. The dam sealing projection is capable of extending over and around the front of the sill channel dam to provide a sealing engagement with the dam.

In the embodiment of the threshold cap described above, optionally included is a rear wall operably engaged with and extending substantially perpendicularly from the bottom support wall so as to be substantially parallel with the front wall.

In the embodiment of the threshold cap described above, the rear wall optionally includes a longitudinally extending projection configured to interact with the threshold assembly to form a sealing barrier along the sill channel.

In the embodiment of the threshold cap described above, optionally included on the rigid top articulating portion is a top wall and a locking wall extending substantially perpendicularly from the top wall.

In the embodiment of the threshold cap described above, optionally included is an intermediate wall having a first leg and a second leg. The first leg can extend perpendicularly from the bottom support wall and the second leg can depend perpendicularly from the first leg toward the rear wall. The locking wall can extend between the rear wall and the second leg and can have a hook portion configured to interact with the second leg to prevent the locking wall from advancing entirely therepast.

In the embodiment of the threshold cap described above, optionally included is a biasing mechanism adapted to bias the top portion toward the one or both of the door panel and the door sweep assembly. Such biasing allows sealing contact therewith when the door panel is in the closed position. The biasing mechanism can be disposed within a cavity at least partially defined by the bottom support wall, the front wall and the articulating top portion.

In the embodiment of the threshold cap described above, the threshold cap can optionally be an integrally-formed and unitary workpiece constructed from a polymer material.

In the embodiment of the threshold cap described above, optionally the front wall includes a cap leg capable of being received within a spacer of the threshold assembly.

An additional embodiment of the invention is a door sweep for a door entryway system. The door sweep can include a support wall capable of attachment to a bottom of a door panel. The support wall can have a first edge and a second edge. The door sweep can also include a resilient sealing provision disposed at the first edge of the support wall. The resilient sealing provision is capable of sealingly engaging a self-articulating threshold cap of the door entryway system when the door panel is in a closed position. Included in the door sweep can be a rigid arm, extending from the support wall and being capable of interacting with the self-articulating threshold cap to deflect a top portion thereof downward when the door panel is moving toward the closed position. The rigid arm is capable of sealingly engaging the self-articulating threshold cap when the door panel is in a closed position.

In an embodiment of the door sweep described above, optionally included is a resilient fin disposed at the second edge of the support wall and extending outwardly therefrom. The resilient sealing provision can be a resilient bulb capable of interacting with the self-articulating threshold cap when the door panel is in a closed position.

In the embodiment of the door sweep described above, the rigid arm can optionally be integrally formed with the support wall.

In the embodiment of the door sweep described above, optionally the rigid arm and the resilient sealing provision are separate and discrete components.

In the embodiment of the door sweep described above, the rigid arm can optionally include an inclined portion angularly extending from the support wall. The rigid arm can also include an arcuate portion extending from the inclined portion. Both the arcuate portion and the inclined portion can be configured to interact with the self-articulating threshold cap such that the threshold cap is initially deflected away from the support wall by the inclined portion and then maintained in sealing contact with arcuate portion when the door panel is in the closed position.

In the embodiment of the door sweep described above, optionally the rigid arm is a plastic material.

In the embodiment of the door sweep described above, optionally included therein is at least one rigid mounting leg with flexible barbs for matingly engaging at least one slot in the door panel bottom face.

An additional embodiment of a door sweep can include a support wall capable of attachment to a bottom of a door panel. The support wall can have a first edge and a second edge. The door sweep can also include a resilient sealing provision disposed at the first, interior, edge of the support wall. The resilient sealing provision is capable of sealingly engaging a self-articulating threshold cap of the door entryway system when the door panel is in a closed position. Included in the door sweep can be a rigid arm extending obliquely from the support wall in close proximity to the resilient sealing provision, and being capable of interacting with the self-articulating threshold cap to deflect a top portion thereof into proper engagement with the resilient sealing provision. Included in the door sweep can be a second rigid member extending downwardly from the support wall near the second, exterior, edge of the support wall. The second rigid member is positioned to initially deflect the top portion of the self-articulating cap while the door panel is being closed.

Another embodiment of the invention is a water management system for a door entryway system. The water management system can include a threshold assembly adapted to span a door entryway along a length thereof. The threshold assembly can include a threshold substrate defining an open-ended sill channel between a first wall and a second wall. A threshold cap can be positioned within the sill channel and can have a front wall facing and spaced apart from the first wall so as to form a gap therebetween, in the absence of at least one sealing provision provided along the length of the gap for sealing thereof.

In the embodiment of the water management system described above, optionally included therein is at least one spacer that is at least partially disposed between the front wall and the first wall so as to maintain the gap formed therebetween. The spacer can extend partially along a length of the gap corresponding to the length of the door entryway such that water is capable of entering the threshold assembly via the gap.

In the embodiment of the water management system described above, the first wall can be a substrate dam and the second wall can be a nosing.

In the embodiment of the water management system described above, optionally included therein are a plurality of the spacers. The spacers can be spaced apart along the length of the gap and each spacer can be at least partially disposed between the front wall and the first wall so as to maintain the gap formed therebetween. The spacing between adjacent spacers allows water to enter the threshold assembly via the gap.

In the embodiment of the water management system described above, the gap distance between the front wall and the first wall can be about 2.0 mm to about 5.0 mm. In other embodiments, however, the gap distance can be smaller than 2.0 mm or larger than 5.0 mm.

In the embodiment of the water management system described above, optionally one spacer can define a spacer channel and a portion of the threshold cap can be received within the spacer channel for securing thereto.

In the embodiment of the water management system described above, the threshold substrate can optionally define at least one chamber in fluid communication with the sill channel via a drain channel defined by the first wall and extending therethrough.

In the embodiment of the water management system described above, the threshold substrate optionally includes at least one drain hole in communication with the at least one chamber. The drain hole (or holes) can be disposed about an exterior edge of the threshold substrate and configured to allow water contained within the chamber to exit the threshold substrate.

In an embodiment of the water management system described above, optionally included in the threshold assembly can be a decking cover plate positioned adjacent to the threshold substrate. The decking cover plate can have a decking dam disposed in planar relation to the first wall such that the decking dam forms an extension thereof with respect to the sill channel.

The invention can include yet an additional, second, embodiment of a water management system for a door entryway system. The water management system can include a threshold assembly adapted to span a door entryway along a length thereof. The threshold assembly can define an open-ended sill channel for at least part of the entryway length. Also included is a water management means for directing water received within the open-ended sill channel out of the threshold assembly. In addition, a gap means can ensure that a gap is provided at the open-ended sill channel such that water is capable of flowing therein.

The second embodiment of the water management system described above can optionally include a drain path means for directing water received within the open-ended sill channel out of the threshold assembly.

The second embodiment of the water management system described above can include an optional chambering means for directing water received within the open-ended sill channel out of the threshold assembly. Also included is an air pressure equalization means for improving water exit flow from the threshold assembly and air flow into the threshold assembly. The air pressure equalization means can include a drain means for draining water from the threshold assembly and air inlet means for allowing air to flow into the threshold assembly separate from the drain means.

These and other features, aspects, and advantages of the disclosure will be apparent from a reading of the following detailed description together with the accompanying drawings, which are briefly described below.

BRIEF DESCRIPTION OF THE DRAWINGS

Figure 1:
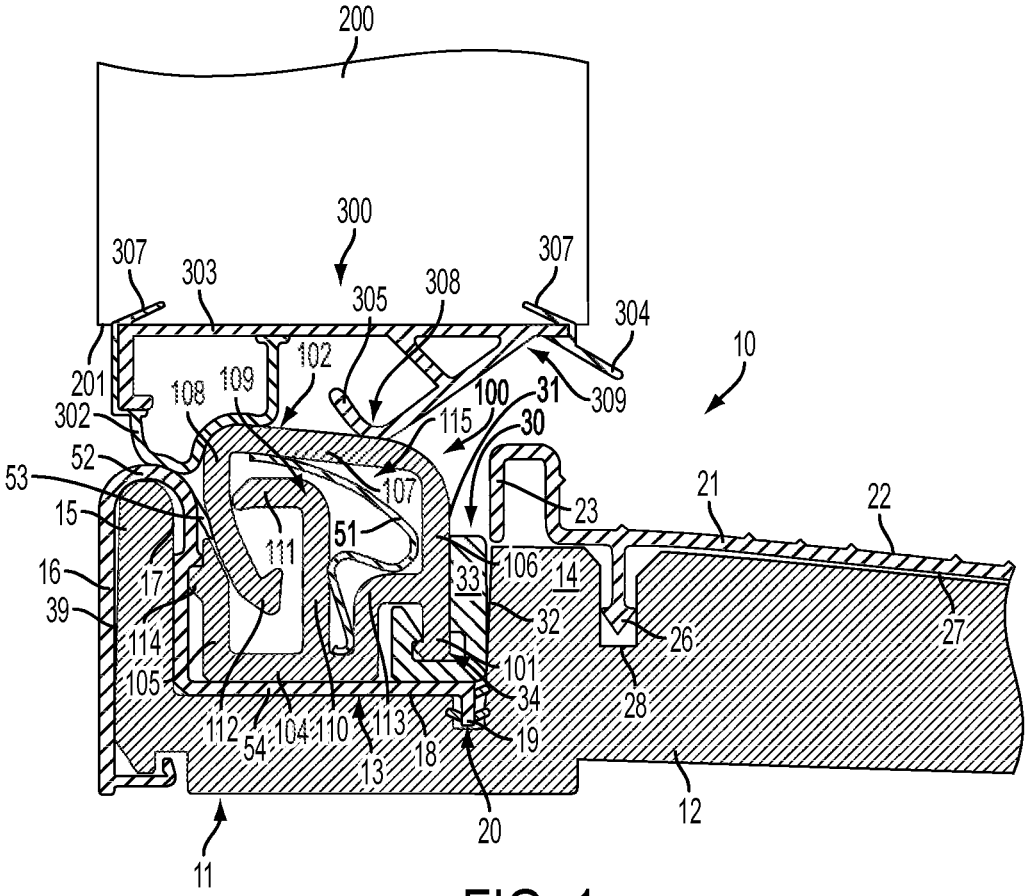
Figure 12:
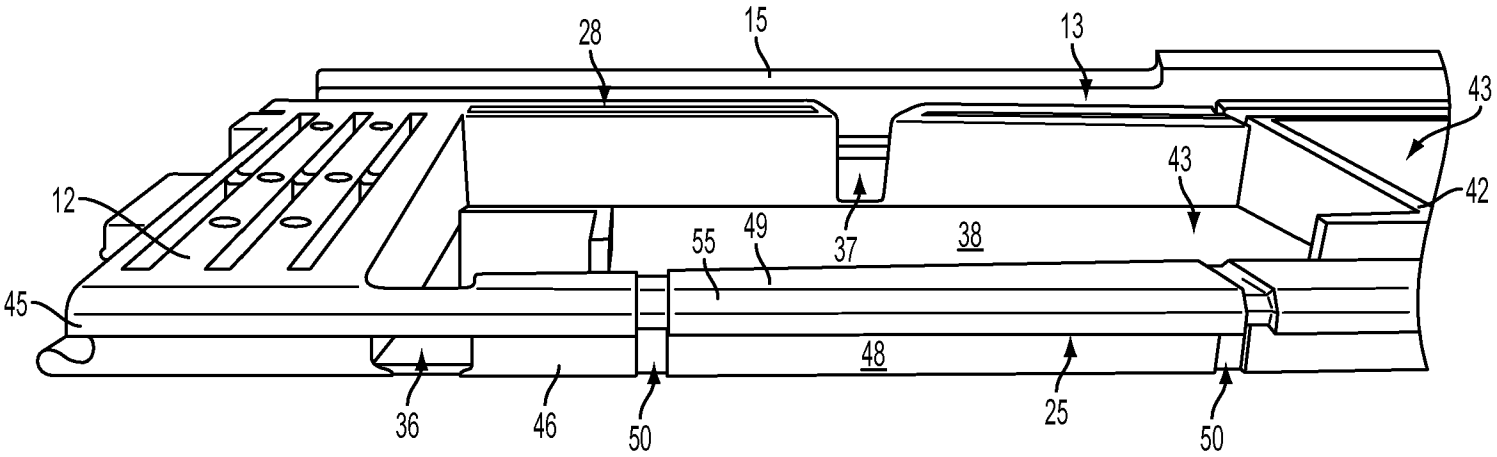
Figure 13:
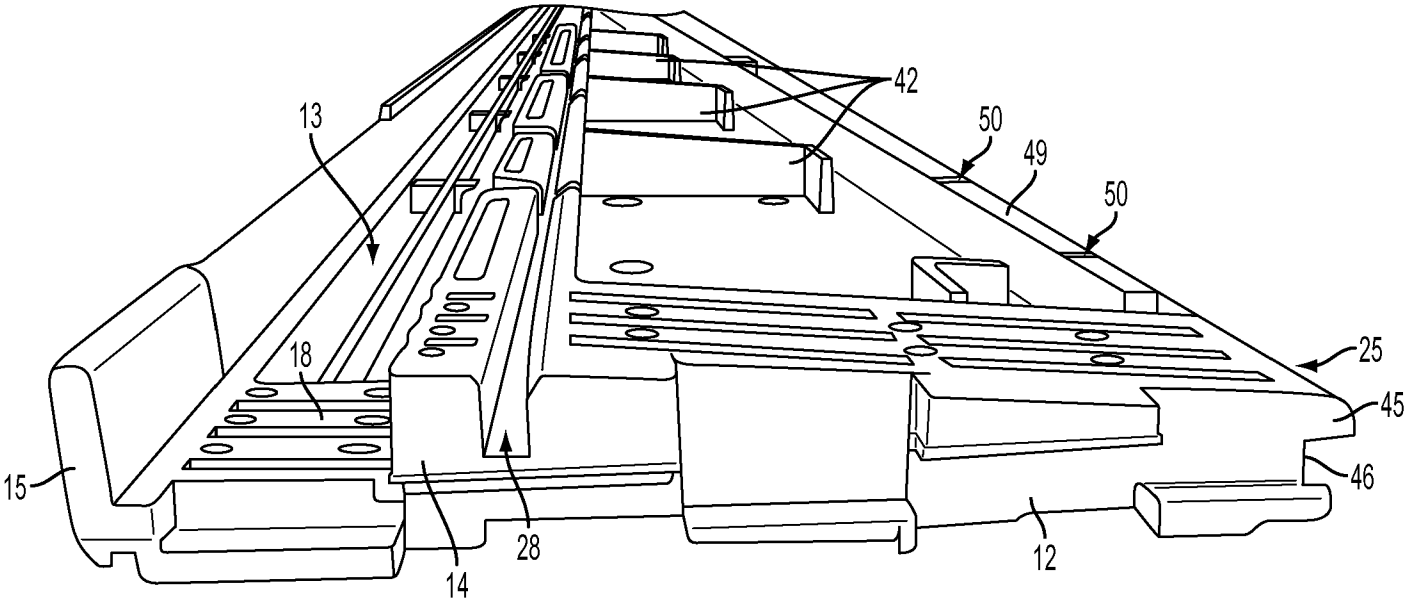
Figure 14:
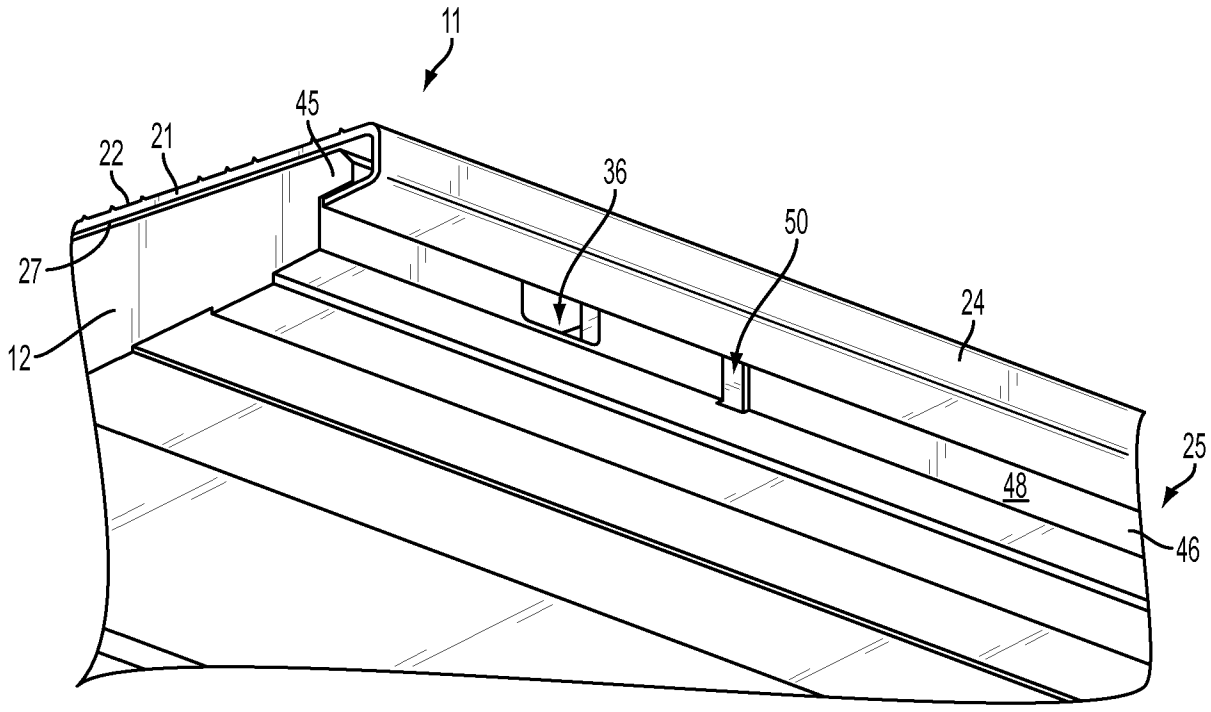
Figure 15:
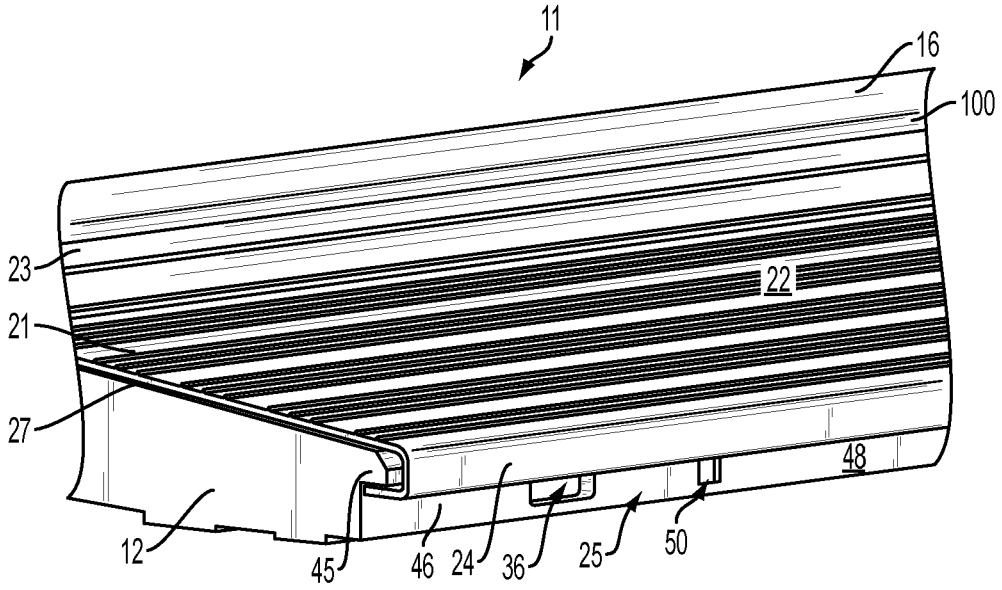
Figure 16:
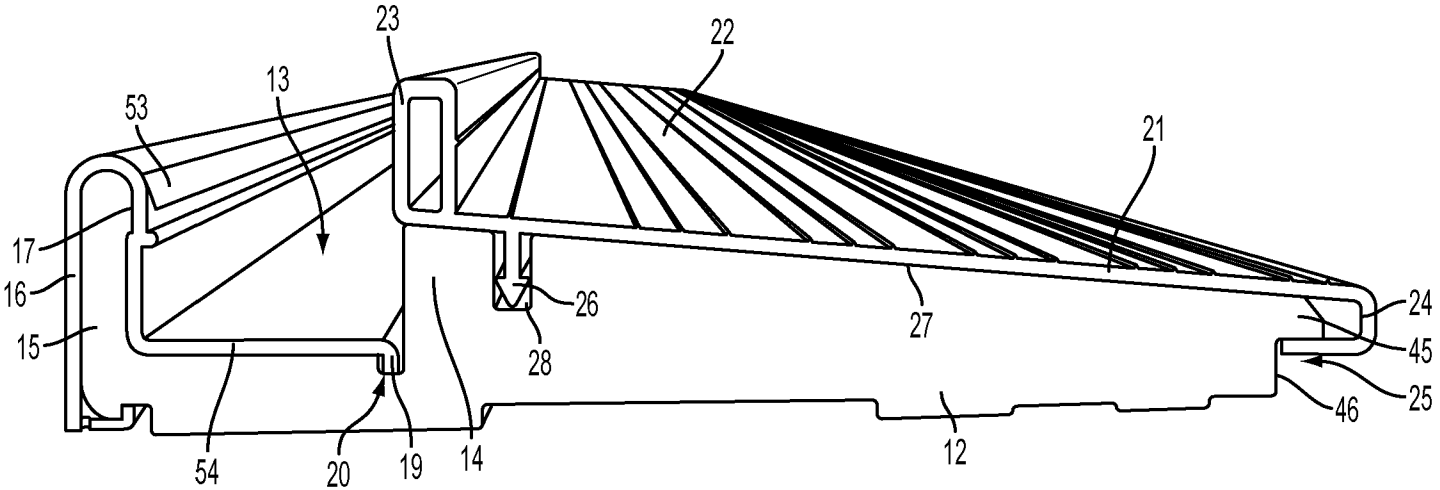
Figure 17:
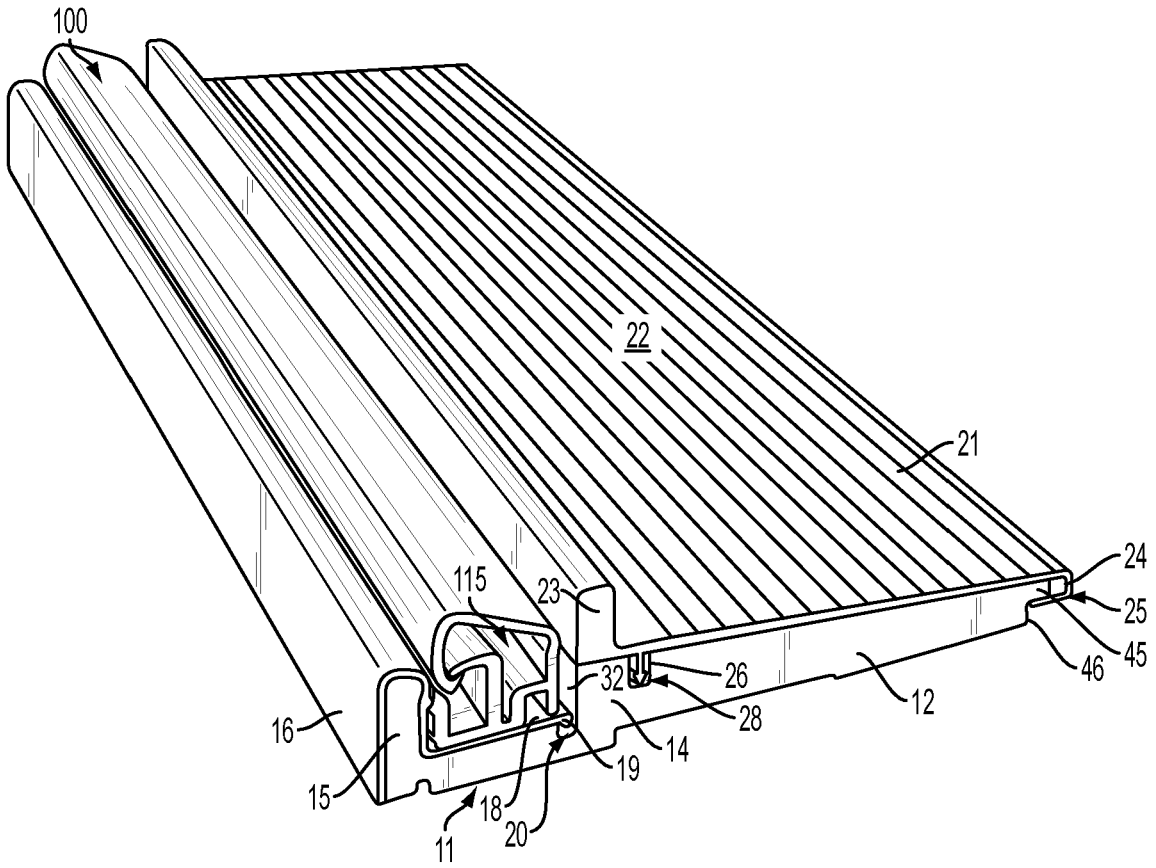
Figure 18:
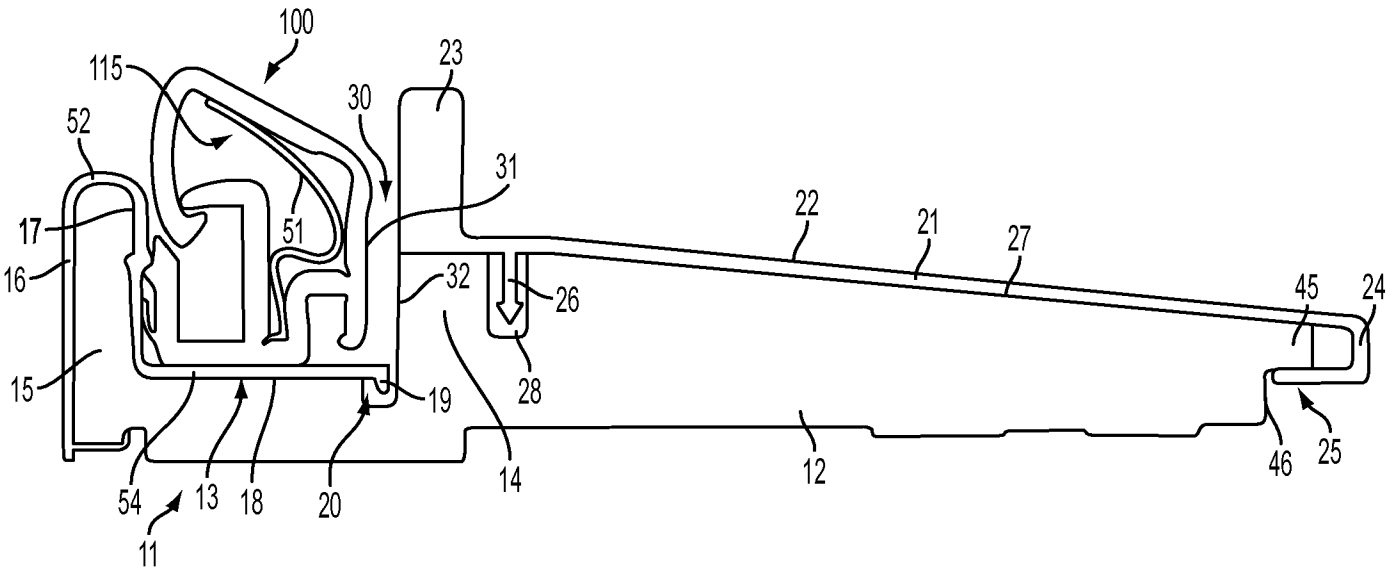
Figure 19:
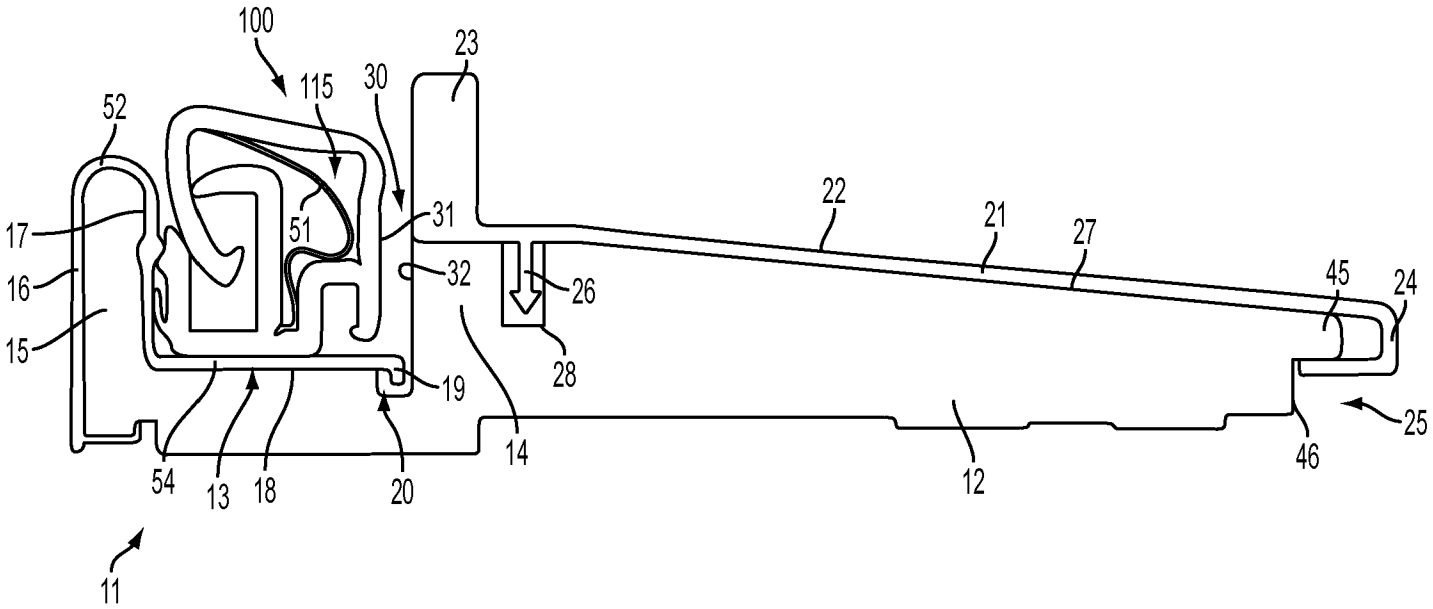
Figure 20:
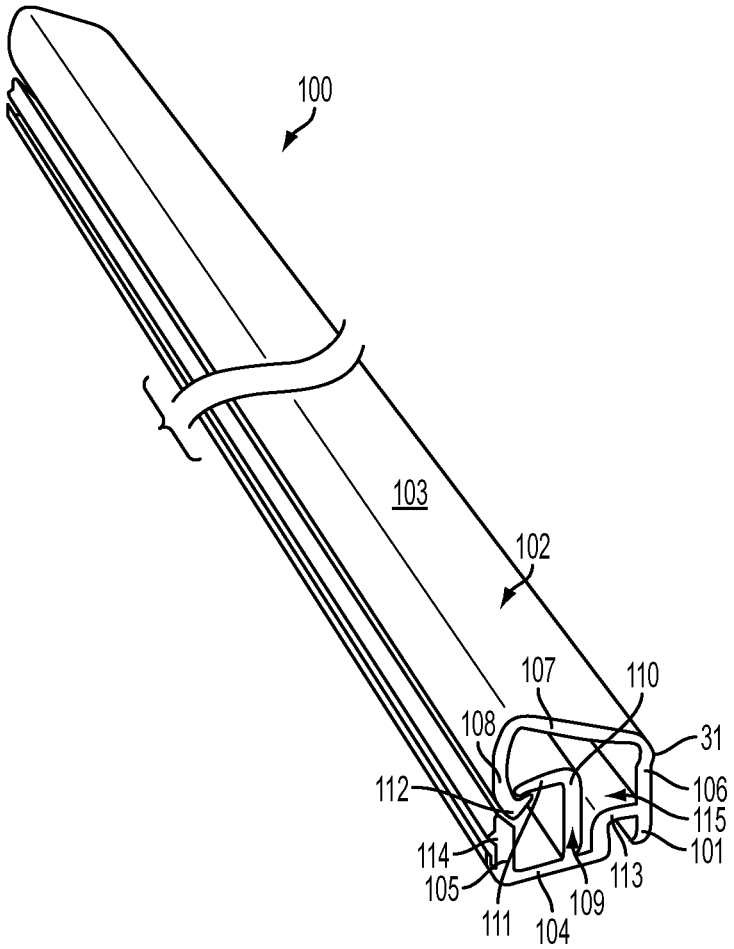
Figure 21:
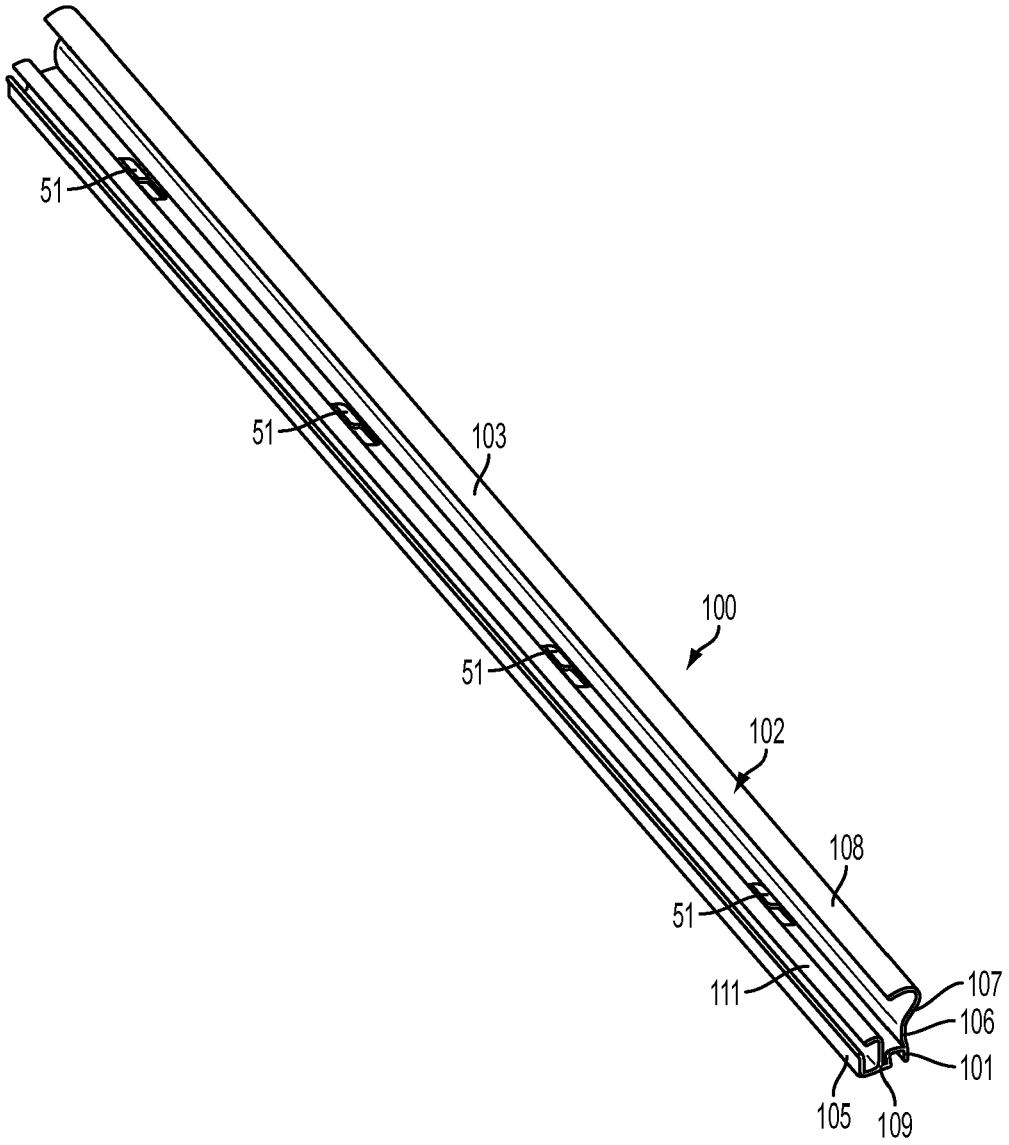
Figure 22:
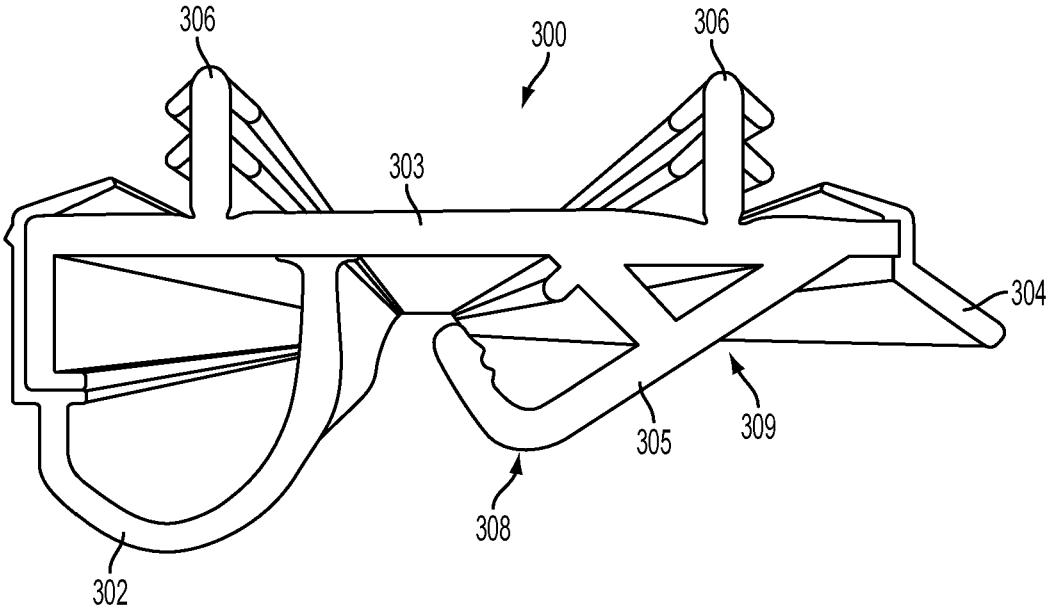
Figure 23:
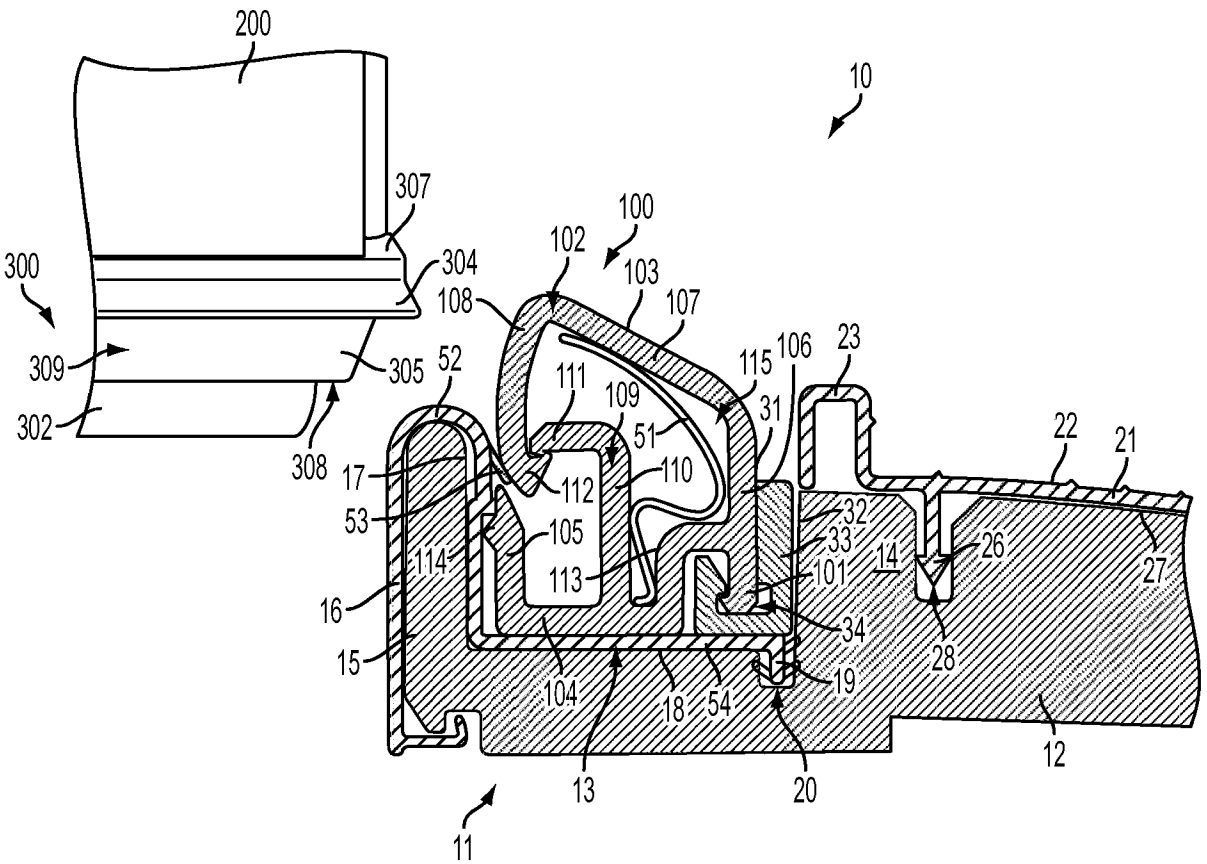
Figure 24:
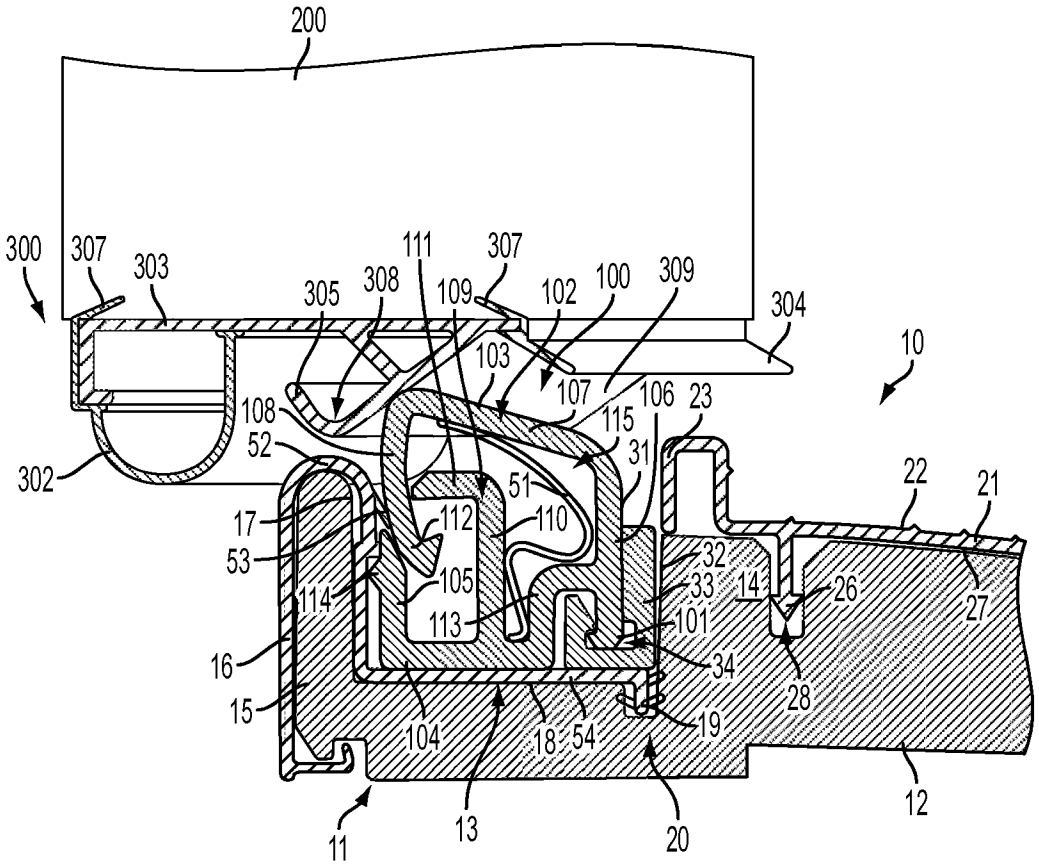

Having thus described the disclosure in general terms, reference will now be made to the accompanying drawings, wherein:

FIG. 1 is a cross-sectional side elevation view of an entryway system having a threshold assembly with a self-articulating threshold cap, and implementing a water management system in accordance with the present disclosure;

FIGS. 2-6 are cross-sectional side elevation views of various entryway systems having a threshold assembly with one of a fixed threshold cap and a manually adjustable threshold cap, and implementing a water management system in accordance with the present disclosure;

FIGS. 7-11 are various views of a threshold assembly having a plurality of spacers disposed between a threshold base substrate and a threshold cap for implementing a water management system in accordance with the present disclosure;

FIGS. 12 and 13 are perspective views of a threshold base substrate for use in accordance with various aspects of the present disclosure;

FIGS. 14-16 are perspective views of a threshold assembly having drain holes and separate air inlets, according to one aspect of the present disclosure;

FIG. 17 is a perspective view a threshold assembly having a self-articulating threshold cap, according to one aspect of the present disclosure;

FIG. 18 is a side elevation view of a threshold assembly having a self-articulating threshold cap in an unbiased position, according to one aspect of the present disclosure;

FIG. 19 is a side elevation view of a threshold assembly having a self-articulating threshold cap in a biased position, according to one aspect of the present disclosure;

FIGS. 20 and 21 are perspective views of a self-articulating threshold cap, according to one aspect of the present disclosure;

FIG. 22 is a perspective view of a door sweep, according to one aspect of the present disclosure;

FIG. 23 is a cross-sectional side elevation view of a threshold assembly having a self-articulating threshold cap not interacting with a door panel in an open position, according to one aspect of the present disclosure; and FIG. 24 is a cross-sectional side elevation view of a threshold assembly having a self-articulating threshold cap interacting with a door sweep of a door panel between a closed and an open position.

Figure 25A:
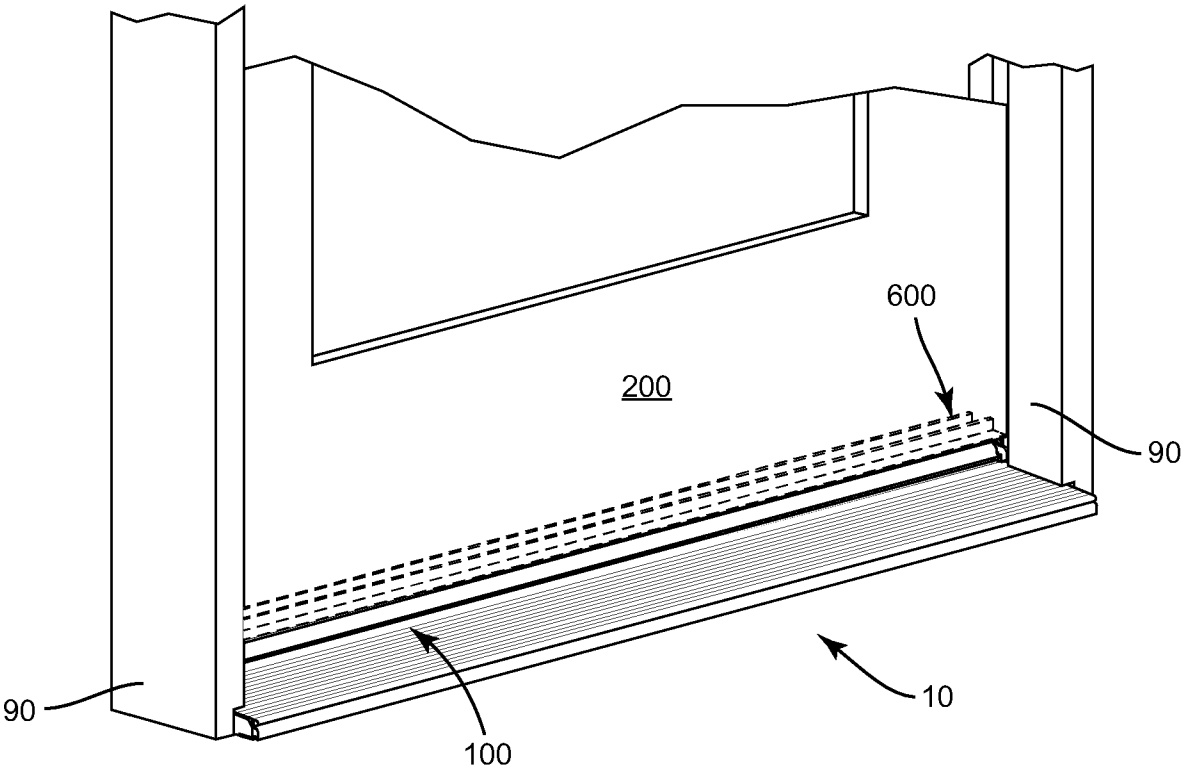

FIG. 25A is a perspective view of another embodiment of the threshold of the present disclosure with door jamb elements shown.

Figure 25B:
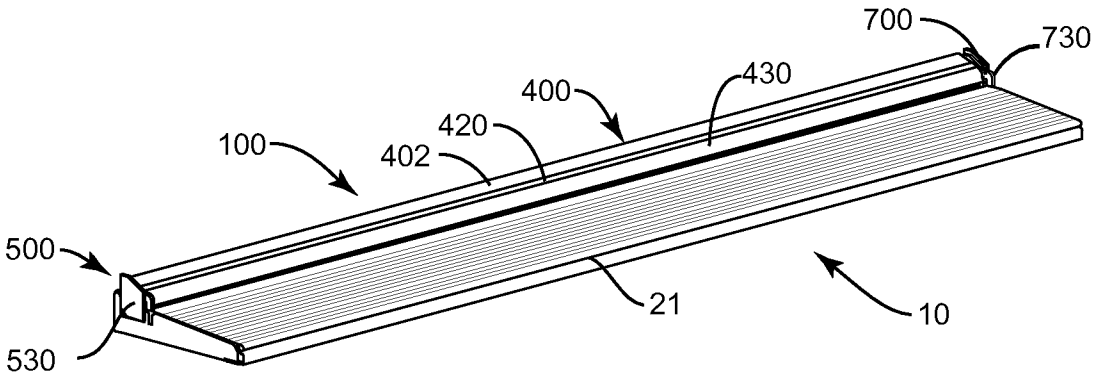

FIG. 25B is a perspective view of the threshold of FIG. 25A with the door jamb elements removed.

Figure 26:
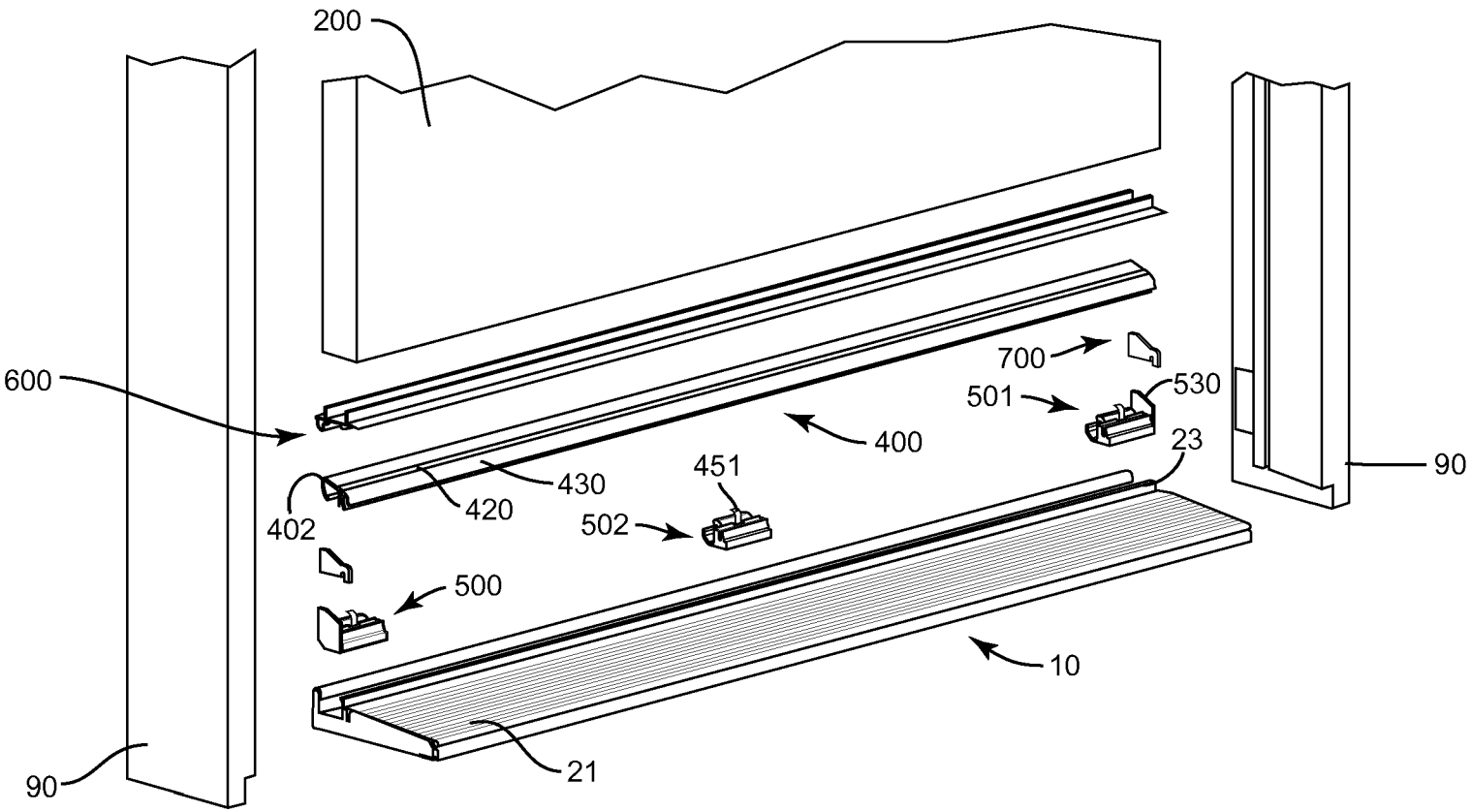

FIG. 26 is an exploded view of the threshold of FIG. 25A.

Figure 27:
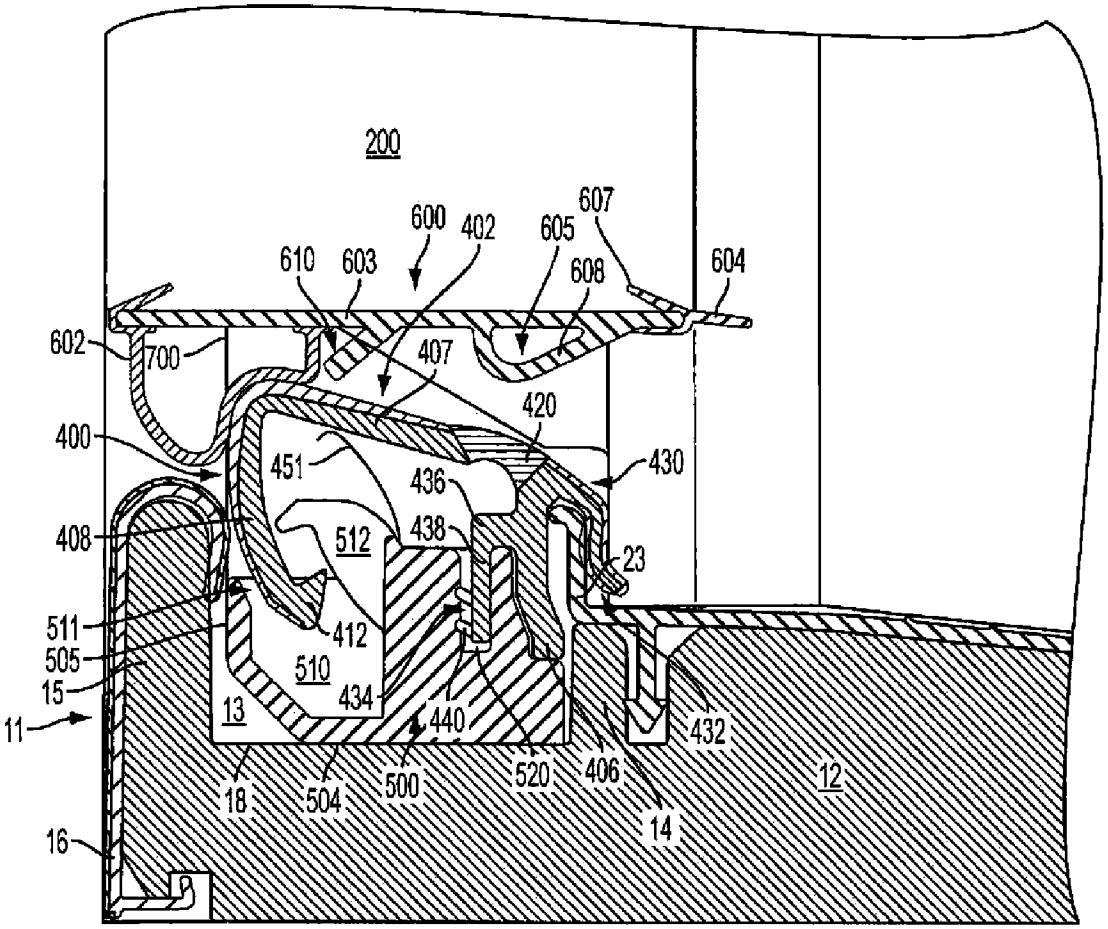

FIG. 27 is a cross-sectional side elevation view of the threshold of FIG. 25 in use with another embodiment of a door sweep according to the present disclosure.

DETAILED DESCRIPTION OF THE DISCLOSURE

The present disclosure now will be described more fully hereinafter with reference to certain preferred aspects. These aspects are provided so that this disclosure will be thorough and complete, and will fully convey the scope of the disclosure to those skilled in the art. Indeed, the disclosure may be embodied in many different forms and should not be construed as limited to the aspects set forth herein; rather, these aspects are provided so that this disclosure will satisfy applicable legal requirements. As used in the specification, and in the appended claims, the singular forms "a", "an", "the", include plural referents unless the context clearly dictates otherwise.

FIGS. 1-6 each illustrate an entryway system 10 having a threshold assembly 11 including a threshold substrate 12, which, in some instances, may be a unitarily molded plastic workpiece. The threshold substrate 12 may be configured to define a longitudinally extending, upwardly open, sill channel 13. The sill channel 13 is flanked along its outside edge by a first channel wall 14 and along its inside edge by a second channel wall, i.e. nosing 15. The first channel wall 14 and the nosing 15 form the outside and inside walls, respectively, of the sill channel 13. The sill channel 13 can be sized to receive a threshold cap 100 (self-adjustable (see FIG. 1); non-adjustable (see FIG. 3); or vertically adjustable (see FIGS. 2 and 4-6)) for underlying a door panel 200 in a closed position. The threshold substrate 12 preferably is made of a deterioration resistant material, but may be made of any other material with appropriate support such as, for example, wood. In some instances, the threshold substrate 12 may be formed by a traditional injection molding process, or by an extrusion process.

As used herein, the term "threshold cap" refers to any element that substantially underlies the end of a door panel, when the door is closed. In embodiments that include a nosing and a dam, the threshold cap bridges the gap between the nosing and the dam of a threshold. Also, a threshold cap is formed of a rigid material providing a portion of the tread (the portion that is walked on and over) of the threshold, and is not made from covered foam as commonly found in weatherstrips.

In some instances, a nosing strip 16 may be attached to an inside edge 17 of the sill channel 13 so as to extend upwardly therefrom over the nosing 15. According to some aspects, the nosing strip 16 may extend across the sill channel 13 to cover a floor 18 thereof. A downwardly projecting nosing barbed tab 19 can be positioned and configured to be snapped into place within a nosing attachment slot 20 to hold the nosing strip 16 securely in place within the sill channel 13.

A decking cover plate 21 may be attached with appropriate means (e.g., mechanical, adhesive, etc.) to the threshold substrate 12 and forms an upper tread surface 22 of the threshold assembly 11. According to some aspects, the decking cover plate 21 may include an upstanding decking dam 23 that extends upward from the first channel wall 14 to provide a water entry barrier that reduces the amount of water directly entering the sill channel 13. The decking cover plate 21 may have a contoured outside edge portion 24 (see FIGS. 14-19) configured to fit over the compatibly contoured forward edge 25 of the threshold substrate 12. A downwardly projecting barbed decking tab 26 may be formed along an underside surface 27 of the decking cover plate 21 and may be positioned and configured to be snapped into place within a decking attachment slot 28 to hold the decking cover plate 21 securely in place on the threshold substrate 12.

While the threshold assemblies 11 of FIGS. 1-6 have discrete components (e.g., the threshold substrate 12, the decking cover plate 21, and the nosing strip 16), it will be understood that this is not a limitation of the disclosure. That is, in some embodiments, the threshold assembly 11 can be formed completely from an aluminum extrusion, can be formed completely from an extruded or injection molded plastic material, or may be a combination thereof. The particular construction of the threshold assembly 11 illustrated in FIGS. 1-6 is chosen because it is a common construction and because it serves well to illustrate the present disclosure. Those of skill in the art will understand, however, that a variety of threshold assembly constructions may well be used without departing from the spirit of the present disclosure.

The elongated threshold cap 100 is disposed in and projects upwardly from the upwardly open sill channel 13. The threshold cap 100 may be formed of single or multiple materials or components, wherein such suitable materials may include wood, plastic, a composite, or another appropriate material. The threshold cap 100 is positioned to underlie a closed door panel 200 mounted in an entryway that includes the threshold assembly 11. In some instances, as shown in FIGS. 2 and 4-6, an array of vertical adjustment screw mechanisms 29 may be provided for selectively and manually adjusting the height of the threshold cap 100 such that the threshold cap 100 sealingly engages a door sweep 300 mounted to a bottom edge 201 of a closed door panel 200 to form a seal between the bottom edge 201 of the door panel 200 and the threshold cap 100. A door sweep 300 can be formed of multiple components.

According to aspects of the present disclosure, a gap 30 may be formed between the forward cap edge 31 of the threshold cap 100 and an inside surface 32 of the first channel wall 14 that defines an outside wall of the sill channel 13. The gap 30 may be in the range of about 0.08 inches (2.03 mm) to about 0.20 inches (5.08 mm) between the forward cap edge 31 and the inside surface 32. For instance, a common dimension of the gap 30 in the threshold assembly 11 may be about 0.14 inches (3.55 mm). Since the gap 30 is exposed to the elements on the outside of a building structure, it can afford the opportunity for rainwater to leak or seep into the upwardly open sill channel 13 and ultimately to the sub floor upon which the threshold assembly 11 rests. In this regard, prior threshold assemblies have attempted to provide a watertight barrier within or otherwise about the gap 30, using sealing provisions, such as, for example, weatherstripping, flexible foam tape, etc., to prevent water from entering the sill channel 13. Accordingly, prior threshold assemblies intend to prevent water from entering the interior of the building structure by attempting to plug all possible water entry points. However, this is difficult to achieve and such sealing provisions typically allow at least some incidental water to seep or otherwise leak into the sill channel 13.

Such prior threshold assemblies may thus provide drain systems that attempt to remove the incidental water from the sill channel 13. However, such prior drain systems may only be capable of handling minimal amounts of water (i.e., incidental water that has leaked through the seal and into the sill channel). In this regard, prior threshold assemblies may not be equipped to handle non-incidental water (i.e., water that is naturally allowed to flow or otherwise enter the sill channel, rather than just minimally leak or seep into the sill channel). Moreover, such prior threshold assemblies may have not envisioned allowing such non-incidental water to enter the threshold assembly.

Accordingly, aspects of the present disclosure seek to allow non-incidental water to enter the threshold assembly 11 and then appropriately manage such non-incidental water. That is, the entryway system 10 of the present disclosure is configured to allow water to enter the sill channel 13 on the exterior of any sealing provisions and then manages the water and provides an avenue for water drainage out of the threshold assembly 11. As such, the gap 30 is not entirely filled or otherwise entirely protected with a sealing mechanism(s) and is, instead, allowed to remain at least partially open-ended to receive non-incidental water therein.

In this regard, the present disclosure accepts that at least some water will enter the threshold assembly 11 regardless of the attempted sealing of the gap 30, and, as such, the present disclosure provides a water management system that allows non-incidental water into the threshold assembly 11 and then appropriately manages the water out thereof. To that end, some aspects of the present disclosure are directed to providing an unobstructed water entry path from the gap 30 to the exterior of a building structure. In some instances, water entry barrier provisions (e.g., flange 304, decking dam 23, fin 301 (see FIG. 6)) may be provided in which such provisions help define the water entry path. But, such provisions do not obstruct the water entry path and instead may, in some instances, only assist in defining the water entry path. In other instances, sealing provisions (e.g., fin 301 (see FIGS. 2-4)) may be provided wherein the water leaks or otherwise seeps through the sealing provision and into the sill channel 13 via the gap 30.

Accordingly, aspects of the present disclosure may provide the gap 30 as partially or entirely unobstructed such that water may flow directly into the sill channel 13. For example, in some instances, the threshold cap 100 may be positioned or secured toward the nosing 15 such that the gap 30 is provided between the threshold cap 100 and the first channel wall 14. Appropriate securement or fastening mechanisms may be provided for ensuring that the threshold cap 100 maintains its spacing from the first channel wall 14 to maintain the gap 30. That is, the threshold cap 100 may be secured toward the nosing 15 so as to maintain the gap 30.

In other instances, one or more spacers 33 may be positioned within the gap 30 to maintain the gap 30 between the forward cap edge 31 of the threshold cap 100 and an inside surface 32 of the first channel wall 14. When a plurality of the spacers 33 is provided, the spacers 33 are spaced apart from each other along a length of the sill channel 13 spanning an entryway, as shown in FIGS. 7-11. In some instances, the spacers 33 may define a spacer channel 34 (FIGS. 1-6) configured to receive a portion of the threshold cap 100 (e.g., a cap leg 101 of a front wall 106 of the threshold cap 100) for securing the spacers 33 within the sill channel 13. The spacers 33 may be disposed between the forward cap edge 31 of the threshold cap 100 and the inside surface 32 of the first channel wall 14 to maintain the gap 30. As such, water may enter the sill channel 13 between the spacers 33. That is, since the spacers 33 do not extend along the length of the sill channel 13 to fully fill the gap 30, there are formed openings 35 between the spacers 33 that allow water to enter the sill channel 13. In this regard, portions of the gap 30 may be left unfilled such that no sealing mechanism is provided between the threshold cap 100 and the first channel wall 14.

Figure 2:
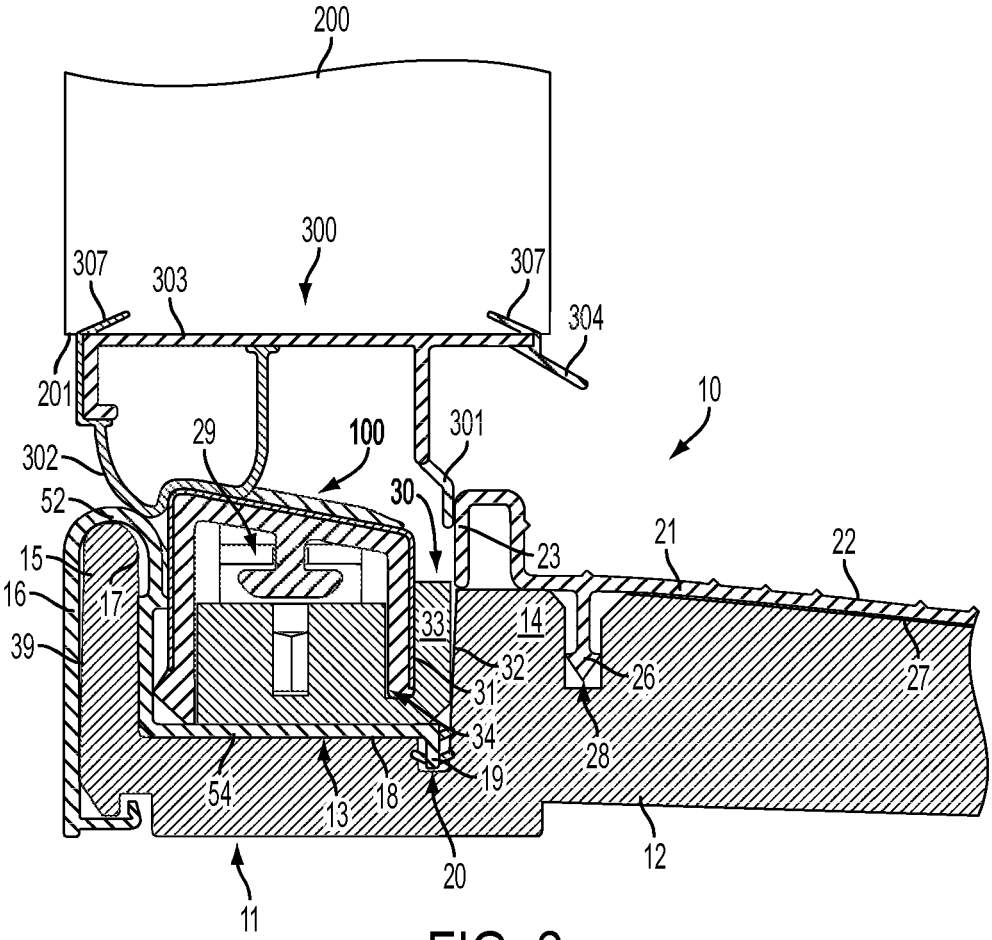
Figure 3:
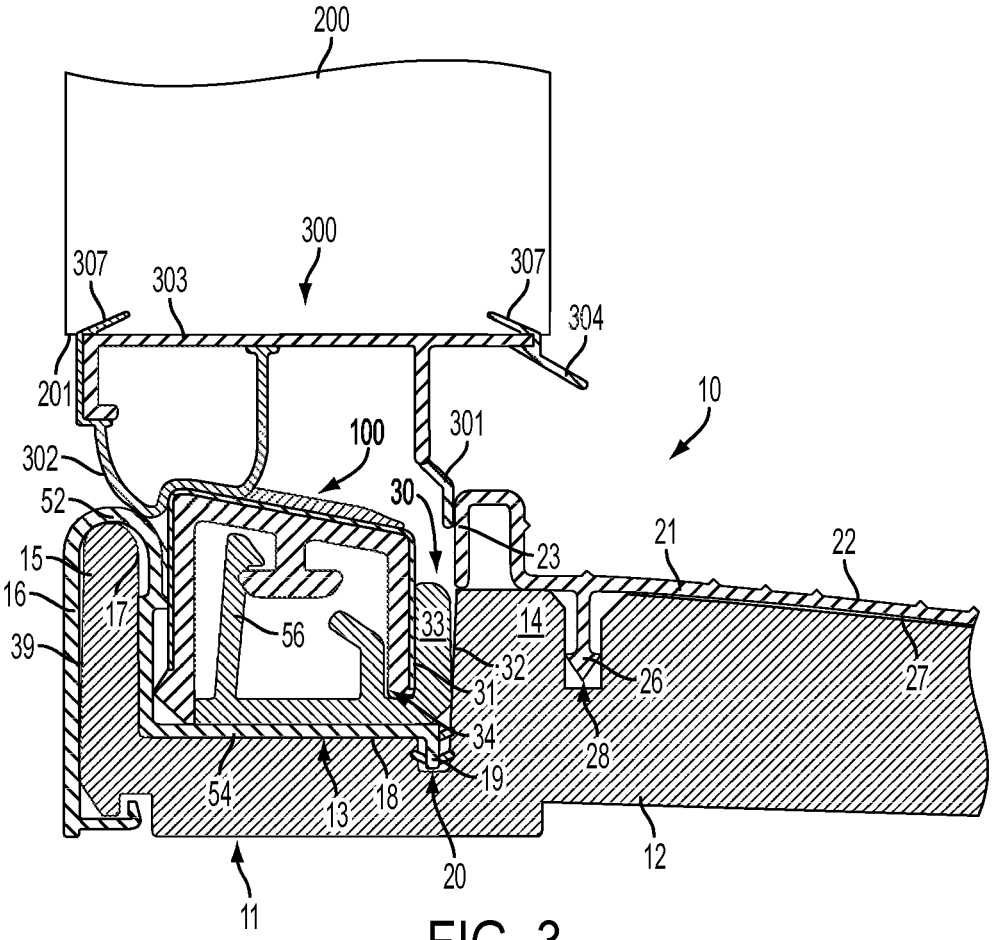
Figure 4:
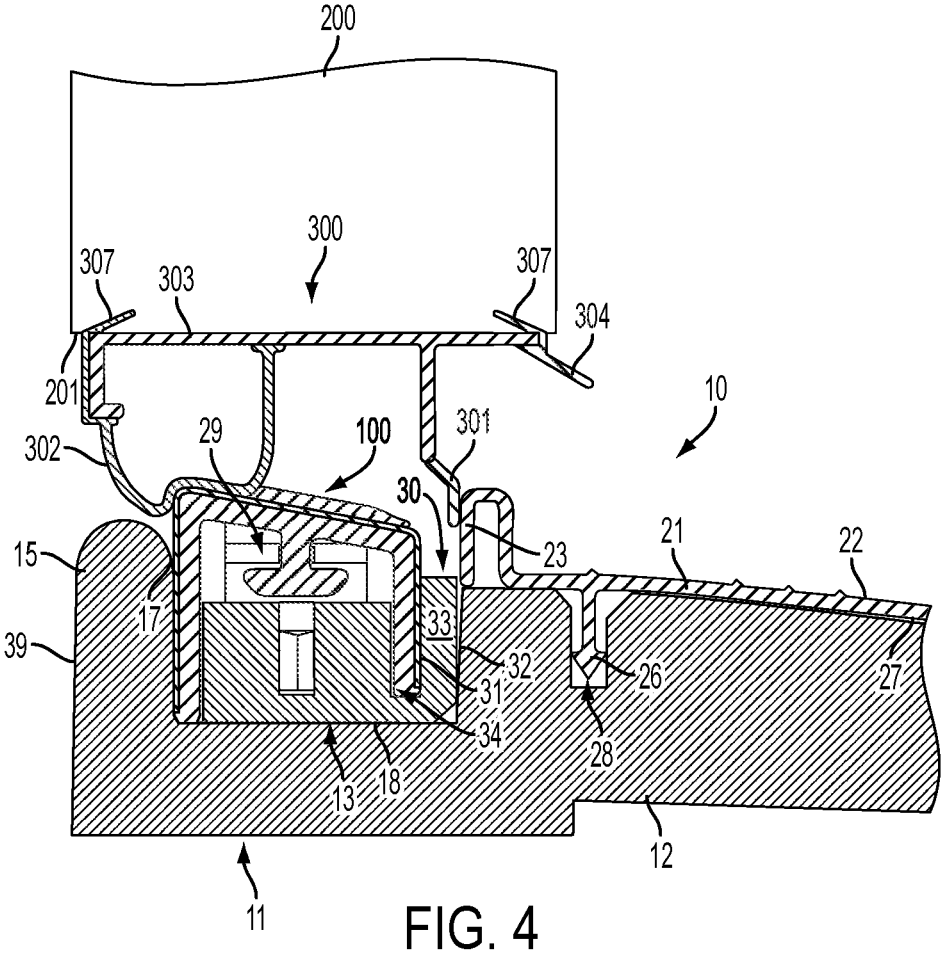
Figure 5:
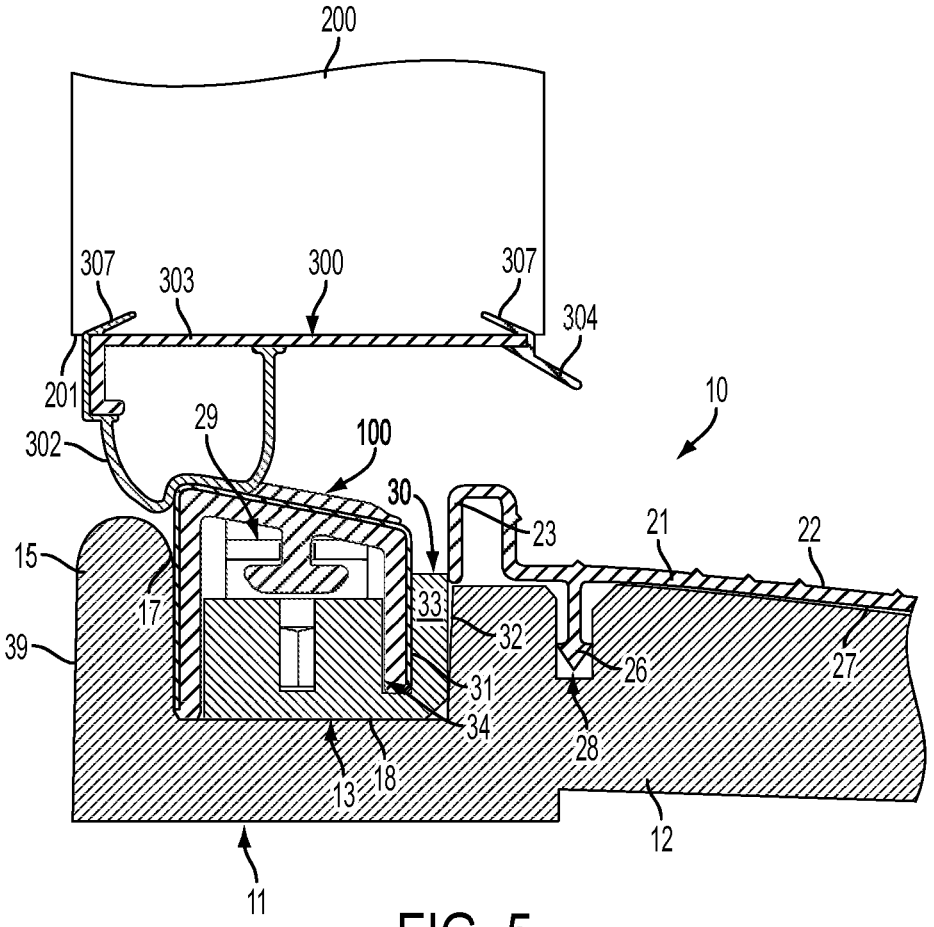
Figure 6:
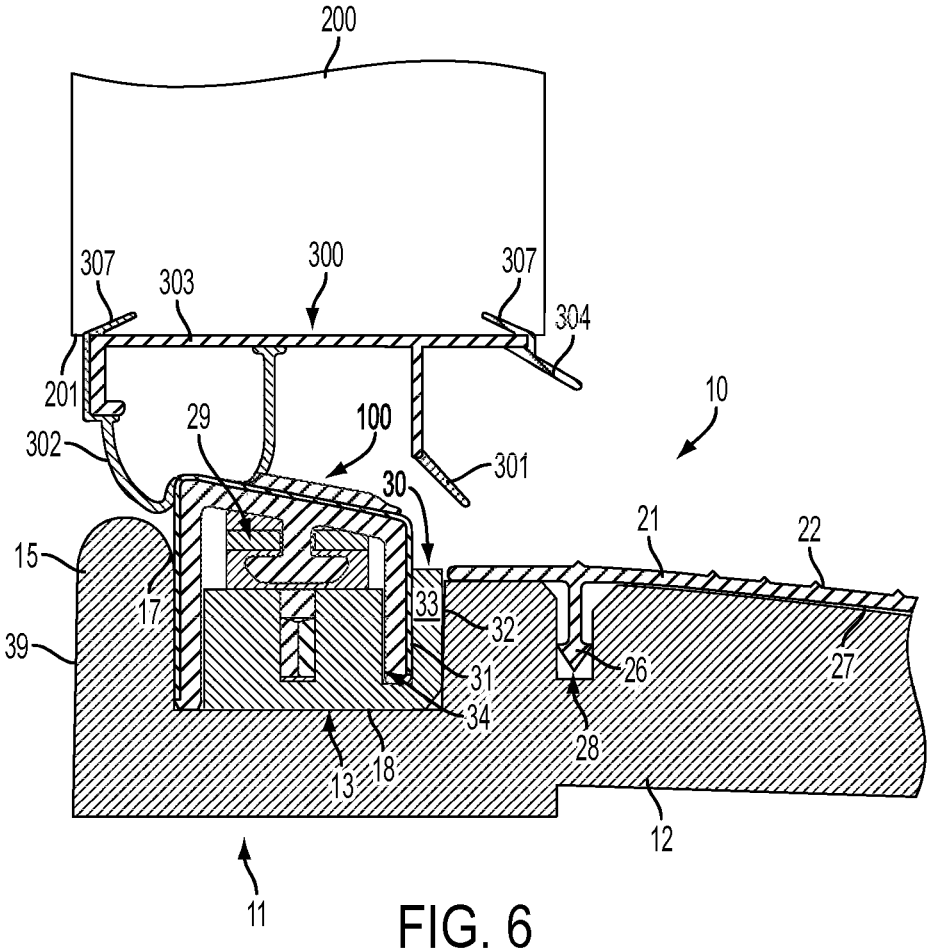
Figure 7:
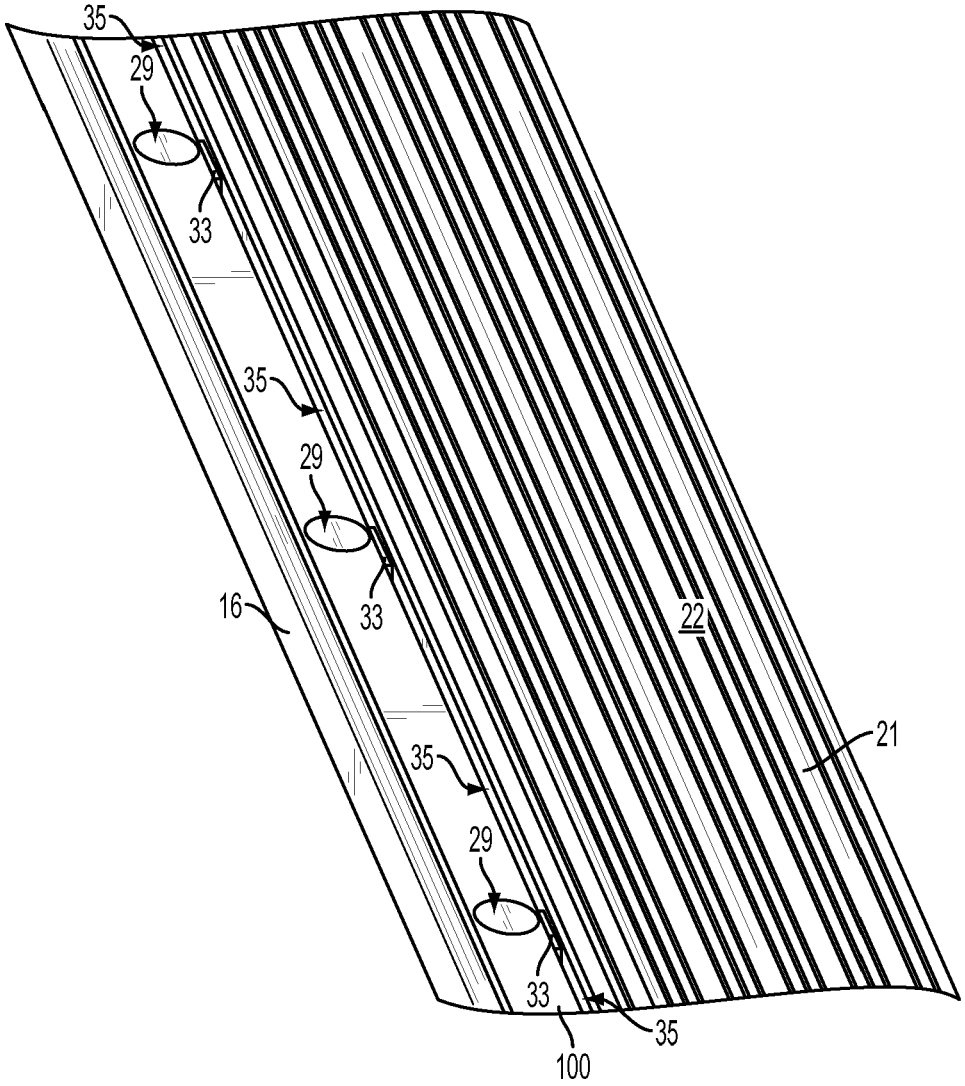
Figure 8:
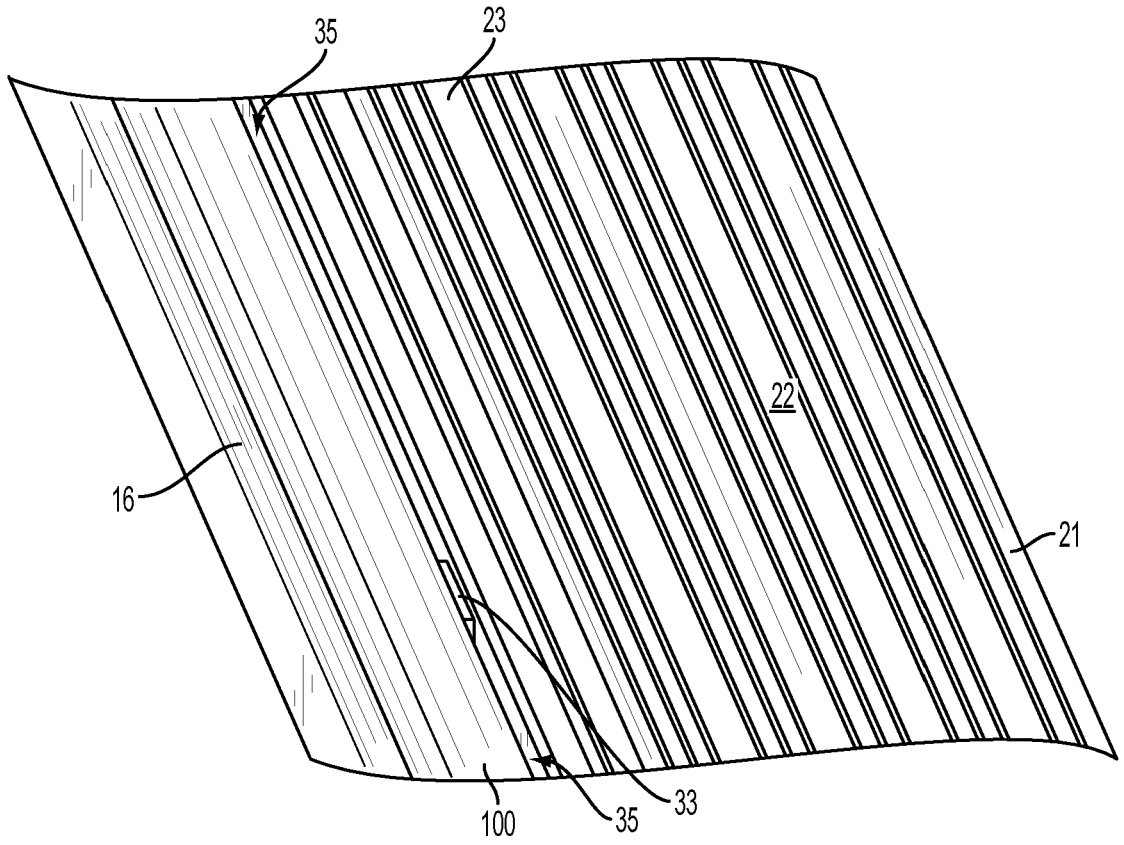
Figure 9:
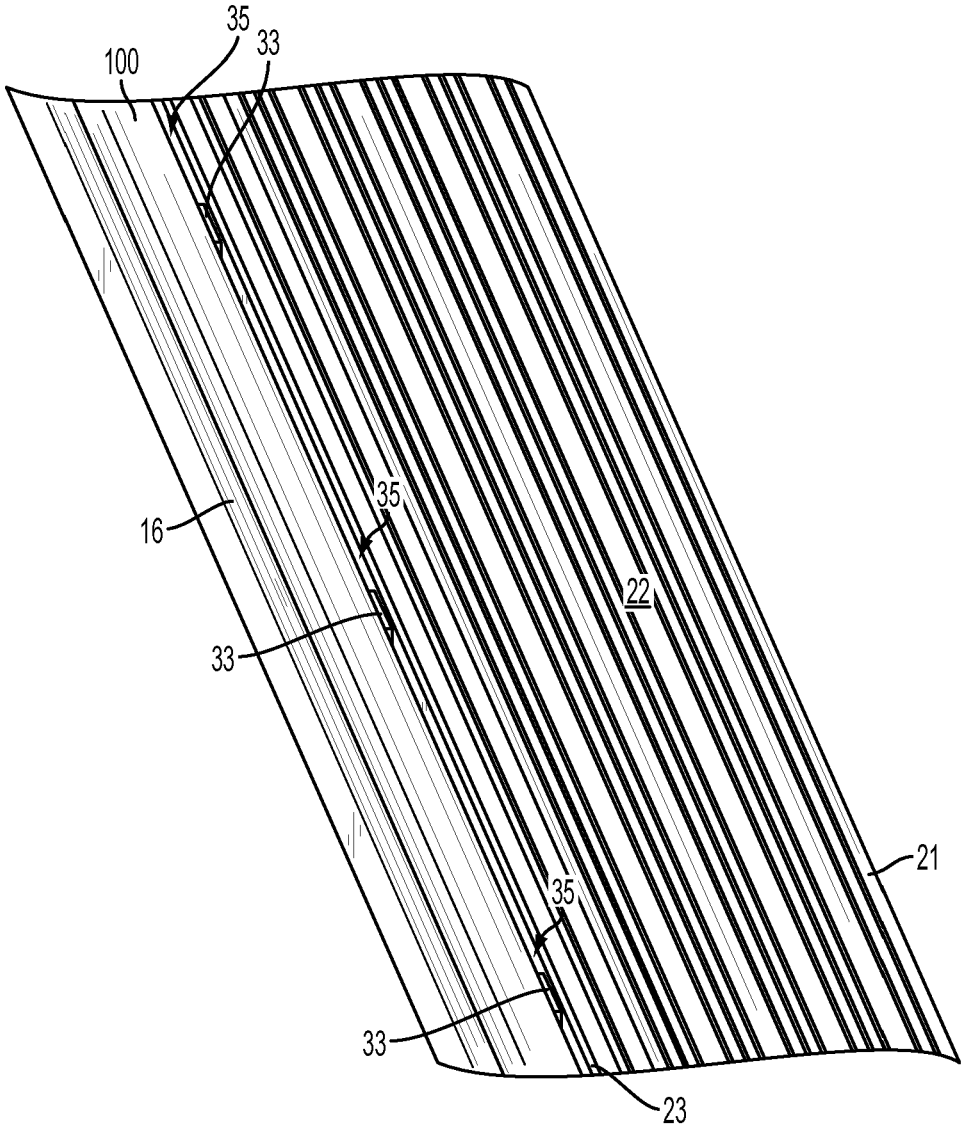

However, in some instances, a sealing provision (e.g., a fin 301) may be provided on the door sweep 300 to limit the amount of water allowed to unimpededly enter the sill channel 13, as shown in FIGS. 2-4. Further, in some instances, the decking dam 23 may provide a similar function (i.e., providing at least some impedance to water entry into the threshold assembly 11).

In some instances, a single spacer 33 of unitary construction may be provided and extended partially or entirely along the length of the threshold assembly 11, wherein the spacer 33 itself may define one or more vertical slots (not shown) extending therethrough or otherwise defined thereby that allow the water to enter the sill channel 13.

The spacers 33 may be of various configurations, as illustrated in FIGS. 1-6. The specific configuration of the spacer 33 may typically depend upon the type of threshold cap 100 incorporated into the threshold assembly 11. Preferably, the spacer 33 may interlock or otherwise securely engage the threshold cap 100 in an interference or snap fit. For example, the spacer 33 may define a spacer channel 34 configured to receive a portion of the threshold cap 100 such as, for example, the cap leg 101. In some instances, the spacer 33 may be configured to accommodate the vertical adjustment screw mechanisms 29 associated with the vertically adjustable threshold cap 100 (FIGS. 2 and 4-6). In other instances, as shown in FIG. 3, the spacer 33 may include one or more spacer walls 56 capable of interacting with various portions of the threshold cap 100. Furthermore, in some instances, the spacer 33 may extend substantially entirely along the floor 18 of the sill channel 13 between the first channel wall 14 and the nosing 15.

Upon entering the gap 30 and flowing into the sill channel 13, the water is managed and directed out of the threshold assembly 11 through the threshold substrate 12. As shown in FIGS. 10-13, the threshold substrate 12 is configured to direct the water from the sill channel 13 out of the threshold assembly 11 via a path that causes the water to eventually exit via one or more drain holes 36 (i.e., weep holes). More specifically, the water is directed out of the sill channel 13 through one or more drain channels 37 defined by the first channel wall 14. The spacers 33 may be offset from the drain channels 37 such that the water can flow from the sill channel 13 into the drain channels 37 according to the corresponding drain path. The water may then be directed out of the drain holes 36 via gravity flow due to a substrate floor 38 of the threshold substrate 12 being downwardly sloped from the sill channel 13 toward the forward edge 25 of the threshold substrate 12.

Figure 10:
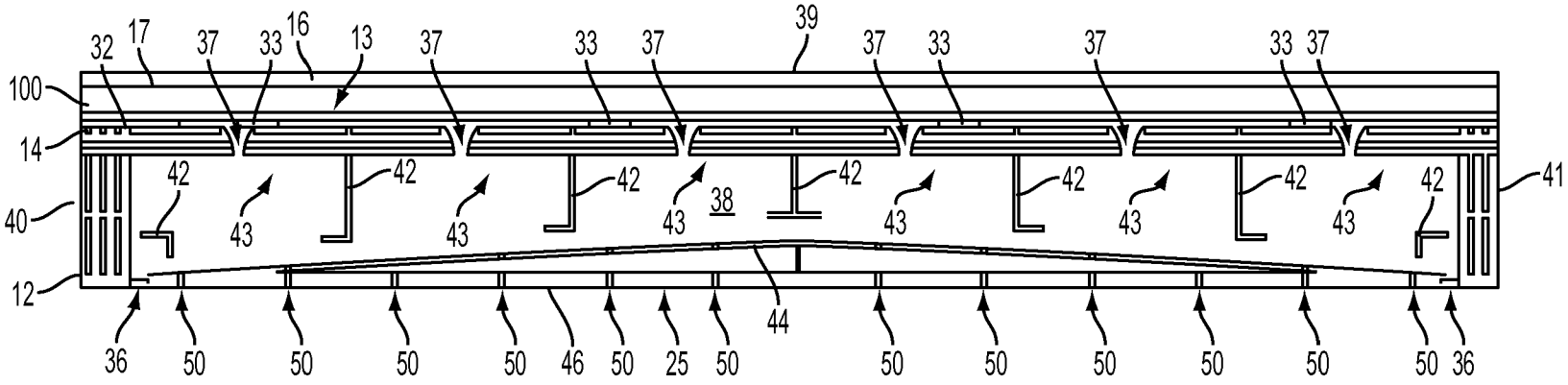

FIGS. 10-13 illustrate a threshold substrate 12 for installation in a threshold assembly 11 according to the present disclosure, where the threshold substrate 12 may comprise molded plastic. The threshold substrate 12 is formed with the forward edge 25, a back edge 39, and a pair of side edges 40, 41. The sill channel 13 is defined adjacent and along the back edge 39 of the threshold substrate 12 for receiving and holding the threshold cap 100. The sill channel 13 is bounded along the back edge 39 of the threshold substrate 12 by the nosing 15. An array of spaced apart support walls 42 extend from the first channel wall 14 proximate to the forward edge 25 of the threshold substrate 12. In this regard, the decking cover plate 21 may be snapped or otherwise secured in place on the threshold substrate 12 covering and being supported by the support walls 42 thereof. The first channel wall 14, the support walls 42, the forward edge 25, and the side edges 40, 41 cooperate to form a plurality of chambers 43 that, in some instances, may be continuously connected. That is, as shown in FIG. 10, the support walls 42 do not extend to the forward edge 25 of the threshold substrate 12. In this manner, the drain holes 36 may be positioned at opposing side ends of the threshold substrate 12. In some instances, the chambers 43 may be closed such that water cannot flow from one chamber 43 to another. In such instances, each chamber 43 may include a corresponding drain hole 36 for permitting removal of water therefrom. A deflector wall 44 may be provided so as to direct water toward the drain holes 36. Additional back pressure walls 42A, 42B assist in preventing water inflow caused by back exterior pressure.

Accordingly, the drain channels 37, which communicate with the sill channel 13 and the drain holes 36, form a water management system for the threshold assembly 11. More specifically, rain water that may collect in the sill channel 13 via the gap 30 is channeled away from the sill channel 13 by flowing to the forward edge 25 of the threshold substrate 12, into the drain channels 37, through the chambers 43, and out the drain holes 36. In this manner, the non-incidental rainwater is appropriately managed such that there is no path for water to leak beneath the threshold assembly and rot or otherwise deteriorate the subfloor upon which it rests and all water is drained to the forward edge 25 of the threshold assembly 11 and out thereof.

Figure 11:
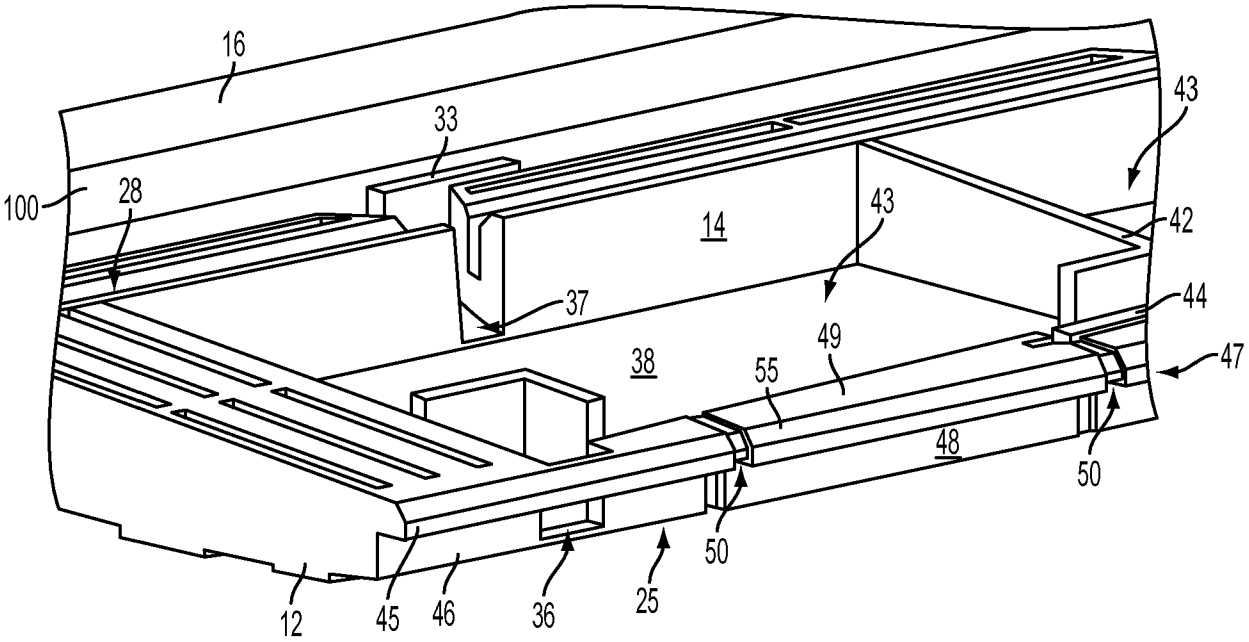

As shown in FIGS. 14-16, according to one aspect of the present disclosure, the outside edge portion 24 of the decking cover plate 21 fits over the forward edge 25 of the threshold substrate 12. In some instances, the forward edge 25 of the threshold substrate 12 may define a lip 45 extending beyond a forward wall 46 of the threshold substrate 12, which may be substantially perpendicular to the substrate floor 38 (FIGS. 11-12). In this regard, the outside edge portion 24 of the decking cover plate 21 may be correspondingly configured to mate with the lip 45, such as, for example, the outside edge portion 24 having a U-shaped profiled configured to wrap about the lip 45. In such a configuration, the decking cover plate 21 terminates above the ground surface such that the drain holes 36 (as defined by the forward wall 46 of the threshold substrate 12) are not covered thereby. That is, the outside edge portion 24 does not extend the entire height of the forward wall 46 so as to leave a portion thereof uncovered. Such a configuration eliminates the need to provide or otherwise define corresponding drain holes 36 in the decking cover plate 21.

As shown in FIGS. 10-12, 14 and 15, according to further aspects of the present disclosure, one or more air inlets 50 may be provided in addition to and separate from the drain holes 36. The air inlets 50 allow air to enter the chambers 43 defined, for example, between the threshold substrate 12 and the decking cover plate 21. According to one particular aspect, the forward wall 46 of the threshold substrate 12 may at least partially define the air inlets 50 (e.g., slots) at an upper end 47 thereof for allowing air to enter the chambers 43. In this regard, the one or more air inlets 50 may be provided in an elevated arrangement with respect to the drain holes 36. In such a configuration, the water may exit the threshold assembly 11 through the drain holes 36 and not through the air inlet(s) 50.

In instances where the threshold substrate 12 is injection molded, the forward wall 46 may be injection molded with recesses that define the air inlets 50. Further, the air inlets 50 may extend from a vertical surface 48 of the forward wall 46 and over a chamfered portion 55 and a top surface 49 of the forward edge 25, such that the decking cover plate 21 is flush against the top surface 49 of the forward edge 25 except at the recessed air inlets 50. That is, the decking cover plate 21 cooperates with the forward wall 46 and forward edge 25 of the threshold substrate 12 to form the air inlets 50, wherein the decking cover plate 21 provides an upper barrier. Such separate air inlets 50 and drain holes 36 provide advantages over prior art threshold assemblies, which have drain holes that provide both an exit for water and an inlet for air to enter the threshold assembly 11 for equalizing air pressure therein.

That is, in prior threshold assemblies, the drain holes typically are used not only to provide an exit for water, but to also allow air to enter the threshold assembly for equalizing air pressure therein. However, such configurations typically allow air to enter the drain holes to the detriment of allowing water to exit therefrom. In this regard, allowing air to enter only through the drain holes can create a bubbling effect. As such, aspects of the present disclosure provide air inlets 50 separate from the drain holes 36, which allows air to enter the chambers 43 via a mechanism other than the drain holes 36.

According to further aspects of the present disclosure, as particularly shown in FIGS. 1, 17-19, 23 and 24, the threshold assembly 11 may include a self-articulating or self-adjusting threshold cap 100. That is, one aspect of the present disclosure is a self-articulating threshold cap 100 capable of self-adjusting to sealingly interact with the underside of the door panel 200 or otherwise with the door sweep 300 attached to the underside of the door panel 200. Self-adjusting refers to the ability for the threshold cap 100 to change height without manual intervention. In most cases, this self adjustment provides a change in the vertical displacement of the threshold cap 100 relative to the threshold assembly 11. In other words, the threshold cap 100 may self-bias against the door panel 200 to maintain contact therewith, regardless of settling of a building or other cause that creates additional or reduced space between the threshold cap 100 and the door panel 200 or door sweep 300. As used herein, "bias" or "biasing" is defined as exerting force in a particular direction. In this embodiment, the bias of the threshold cap 100 causes the forming of a sealing barrier when door is closed. This barrier is formed regardless of the differences in spacing that might occur between these two elements. Such a configuration is contrasted with prior threshold caps that are fixed or otherwise manually adjustable in a vertical direction using, for example, vertical adjustment screw mechanisms 29 (see FIGS. 2-6). The threshold cap 100 may be configured for removal and replacement within a threshold assembly 11 either before or after installation thereof in an entryway. In some instances, the threshold cap 100 may include a mechanism, integral or otherwise, causing it to remain in contact with the door panel 200 as intended. In this regard, the threshold cap 100 is not manually adjusted, but instead may be displaced by the movement of the mating door panel 200 or the door sweep 300. The threshold cap 100 may be integrally formed and may be constructed from a plastic or polymeric material using, for example, an extrusion process. The material of construction of the threshold cap 100 may have a hinge feature that allows the threshold cap 100 to inherently bias against the door panel 200 when in contact therewith. That is, the threshold cap 100 may be formed of a polymeric material that permits at least a portion thereof to flex or otherwise deflect in accordance with the structural aspects of the present disclosure. In this regard, the threshold cap 100 may include an integral feature causing a portion thereof to tend to stay in a position biased toward the door panel 200 or the door sweep 300. According to some aspects, the threshold cap 100 may include supplemental biasing mechanisms used to assist a portion of the threshold cap 100 to tend to stay in an upward position (e.g., a biasing spring 51).

As shown in FIGS. 17-21, according to one particular aspect of the present disclosure, the threshold cap 100 may include a rigid articulating top portion 102 having a continuous surface 103 capable of interacting with the door panel 200 or the door sweep 300. The threshold cap 100 may include a stationary body comprising a bottom support wall 104, a rear wall 105 and a bottom support wall 106 in a hinged relationship with the rigid articulating top portion 102. The bottom support wall 104 is capable of being disposed within the sill channel 13 to engage the floor 18 thereof. The rear wall 105 may extend perpendicularly from the bottom support wall 104. The rear wall 105 may include a projection 114 capable of interacting with the nosing 15 or the nosing strip 16 (when provided) to form a sealing barrier therewith. The front wall 106 may depend from the bottom support wall 104 or otherwise be connected thereto via, for example, an arcuate portion 113, and at least a portion of the front wall 106 may be substantially perpendicular to the bottom support wall 104. In some instances, the front wall 106 may include an extension, such as, for example, the cap leg 101, configured to be securely received within the spacer channel 34. The articulating top portion 102 extends from the front wall 106. The articulating top portion 102 is configured to self-bias against the underside of the door panel 200 or the door sweep 300 when the door panel 200 is in the closed position. The articulating top portion 102 may include a top wall 107 and a locking wall 108 extending substantially perpendicular to the top wall 107. The area of the articulating top portion 102 that is proximate to the intersection of the top wall 107 and the locking wall 108 forming the uppermost portion.

The threshold cap 100 may further include an intermediate wall 109 disposed between the rear wall 105 and the front wall 106. The intermediate wall 109 acts to constrain the articulating top portion 102. The intermediate wall 109 may include a first leg 110 and a second leg 111. The first leg 110 may extend perpendicularly from the bottom support wall 104. The second leg 111 may depend perpendicularly from the first leg 110 toward the rear wall 105. The locking wall 108 may extend between the rear wall 105 and the second leg 111. In some instances, the locking wall 108 may have a hook portion 112 configured to interact with the second leg 111 to prevent the locking wall 108 from advancing therepast, thereby limiting the upward travel of the articulating top portion 102. A cap leg 101 may be provided for being received within the spacer channel 34 such that each spacer 33 is maintained within the sill channel 13. It is noted that the described legs, walls, and portions of the threshold cap 100 substantially extend along the entire length thereof.

FIG. 23 illustrates one aspect of a threshold assembly 11 according to the present disclosure in which the door panel 200 is in an open position, wherein the threshold cap 100 is not interacting with the door sweep 300. In some instances, the self-articulating threshold cap 100 may include the biasing spring 51 or other biasing mechanism configured to bias the articulating top portion 102 of the threshold cap 100 in an upwardly position for interacting with the door sweep 300. In some instances, the biasing spring 51 or other biasing mechanism may be disposed within a cavity 115 generally defined by the threshold cap 100 and extending along the length thereof. In some instances, the cavity 115 may be defined by the bottom support wall 104, the arcuate portion 113, the front wall 106, the intermediate wall 109, and the articulating top portion 102.

FIG. 24 illustrates the door panel 200 in a partially closed position, wherein the door sweep 300 has started to engage and interact with the threshold cap 100. As shown, the door sweep 300 interacts with the threshold cap 100 so as to force the top portion 102 thereof downward such that at least a portion of the door sweep 300 can advance therepast. More particularly, the door sweep 300 interacts with the top portion 102 to force the top wall 107 downward from an inclined position to an orientation substantially parallel to the bottom support wall 104. In this manner, the top portion 102 may move from a biased position to an unbiased position when interacting with the door panel 200 or the door sweep 300.

FIG. 1 illustrates the door panel 200 in a closed position, wherein the door sweep 300 is entirely engaged with the threshold cap 100 along the length of the threshold assembly 11. In this regard, the rigid articulating top portion 102 of the threshold cap 100 is biased upward toward the door panel 200 to sealingly interact with a resilient bulb 302 of the door sweep 300 to form a sealing barrier. As used herein, an element is resilient when, upon compression, the structure changes shape, and upon removal of compression, the structure substantially returns back to its original shape. Further, at least one portion of the nosing strip 16 may be configured to contact the threshold cap 100 along the length of the threshold assembly 11 so as to form an additional seal therewith. In some instances, both the door sweep 300 and the nosing strip 16 may be configured to contact the threshold cap 100 upon closing of the door panel 200 such that multiple sealing barriers are formed along the length of the threshold assembly 11.

The nosing strip 16, which may be of extruded plastic with a wood grain or other appropriate appearance, may be snapped or otherwise attached into place covering the nosing 15 of the threshold substrate 12. The nosing strip 16, which is visible from the inside of a building structure, covers the nosing 15 of the threshold substrate 12 and hides any junctions between adjacent threshold substrates 12. According to some aspects, the nosing strip 16 may include a nosing portion 52, a nosing fin 53, and a sill channel cover portion 54. The nosing portion 52 may extend about the nosing 15 of the threshold substrate 12, from within the sill channel 13 to the back edge 39 of the threshold substrate 12. A barbed tab 19 of the nosing strip 16 may be configured to be received within the nosing attachment slot 20 so as to engage the threshold substrate 12 for anchoring thereto. The nosing fin 53 may be flexible and capable of interacting with the locking wall 108 of the threshold cap 100 to form an additional seal along the length of the threshold assembly 11. Further, in some instances, a resilient sealing provision (e.g., resilient bulb 302) of the door sweep 300 may sealingly contact the nosing strip 16, and top wall 107. As previously mentioned, the nosing strip 16 may extend across the floor 18 of the sill channel 13. In such instances, the nosing strip 16 may be used to extend across adjacent threshold substrates 12, which interlock, for covering a seam formed between the adjacent threshold substrates 12, as disclosed in U.S. Pat. No. 7,350,336 to Bennett, which is assigned to Endura Products, Inc. (also the assignee of the present disclosure), and which is hereby incorporated herein by reference in its entirety.

As shown in FIGS. 1 and 24, the door sweep 300 may be integral with or otherwise attached, secured or fixed to a bottom portion of the door panel 200. In some instances, the door panel 200 includes an underside or bottom edge 201 with the door sweep 300 flush thereagainst. According to some aspects, the door sweep 300 may include a support wall 303 secured to the bottom edge 201 of the door panel 200 and extending along the width thereof. The door sweep 300 may be attached to the door panel 200 using, for example, one or more door sweep barbs 306 (as shown in FIG. 22) capable of being received within corresponding door slots (not shown) defined by the door panel 200. A flange 304, an arm 305, and the resilient bulb 302 depend from the support wall 303. The flange 304 and resilient bulb 302 are preferably flexible, while arm 305 is preferably rigid. In some instances, all three may be integrally formed with the support wall 303. While it is preferred that resilient bulb 302 be generally ovoid, other suitable shapes are possible, such as resilient fins. It should be understood that resilient bulb 302 extends the length of the door sweep 300, but since the cross-sectional shape is bulb-like, it is described as a bulb.

The flange 304 may include a flexible seal fin 307 that fits between the door panel 200 and support wall 303 for sealing the joint between the door panel 200 and door sweep 300, thus preventing water penetration along the joint.

The, preferably rigid, arm 305 can be configured to interact with the threshold cap 100 so as to force the articulating top portion 102 thereof in a substantially downward direction (toward the floor 18 of the sill channel 13) as the door panel 200 is moved to the closed position. The arm 305 continues to maintain contact with the threshold cap 100 due to the upward biasing thereof by, for example, the biasing spring 51, thereby forming a first seal along the length of the entryway system 10. In this regard, the arm 305 interacts with the continuous surface 103 and compresses the articulating top portion 102 of the threshold cap 100 into an unbiased position. The arm 305 may be constructed of any suitable material, such as, for example, a plastic material, and may be integrally formed with the support wall 303.

The arm 305 may include an arm arcuate portion 308 and an inclined portion 309, both configured to interact with the threshold cap 100 such that the threshold cap 100 is initially forced downward and then allowed to bias against the door sweep 300. In this regard, the inclined portion 309 may be in a sloped configuration with respect to the support wall 303 such that the inclined portion 309 provides the initial contact between the door sweep 300 and the threshold cap 100. Upon contact, the top portion 102 of the threshold cap 100 then rides along the inclined portion 309, towards the arm arcuate portion 308, so as to maintain contact therewith as the door panel 200 is moved to the closed position. Continuing, as the door panel 200 is closed, the arm arcuate portion 308 eventually contacts the top portion 102 and forces the top portion 102 downward to a lower position. As the arm arcuate portion 308 moves along the top wall 107, while maintaining contact therewith due to the upward biasing of the threshold cap 100, the top portion 102 moves upward away from the floor 18 and into sealing contact with the door sweep 300 upon the door being in a fully closed position.

As shown in FIG. 1, the resilient bulb 302 may be configured to sealingly interact with the threshold cap 100, thereby forming a second seal along the length of the entryway system 10. In some instances, the resilient bulb 302 may also be capable of contacting the nosing strip 16 to form an additional sealing barrier along the length of the entryway system 10, as shown in FIG. 1. Thus, the door sweep 300 and the threshold cap 100, when used together, provide a strong positive seal between the door panel 200 and the threshold assembly 11.

FIG. 25A shows an entry system 10 disposed between door jambs 90 and below a door panel 200. The bottom of the door panel 200 includes one embodiment of a door sweep 600. The entryway system 10 includes one embodiment of a self articulating threshold cap 100.

FIG. 25B shows the entryway system 10 of FIG. 25A having an exemplary embodiment of a threshold cap 100 comprising an upper cap 400 and at least one cap base 500. Disposed adjacent to the ends of the upper cap 400 may be side gaskets 700. The side gaskets 700 are sized to be accepted into the sill channel 13. The side gaskets 700 may be held in sealing contact with the ends of the upper cap 400 by a respective cap base 500. In some embodiments, the cap base 500 is provided with an end wall 530 for supporting the side gasket 700. The side gasket 700 may be adhered to the end wall 530. The end wall 530 provides both a connection surface for the side gasket 700 but also provides a rigid structure capable of supplying the side gasket 700 and end of the upper cap 400 with constant pressure. The upper cap 400 includes a rigid articulating top portion 402, supported and biased upwardly by a hinge 420. The upper cap 400 also includes a dam cover 430 configured to seal with decking dam 23 (see FIG. 26) of decking cover plate 21. A similar dam sealing portion 730 may extend from the side gasket 700 to also cover the decking dam 23 and help prevent water intrusion.

FIG. 26 shows an exploded view of the elements of FIG. 25A. As best seen in the exploded view of FIG. 26, the upper cap 400 in this embodiment extends substantially the full width of the entryway system 10. The upper cap 400 is then supported by at least one cap base 500 disposed along the length of the upper cap 400. In a preferred embodiment, a cap base 500, 501 is disposed proximate to each distal end of the upper cap 400. In a more preferred embodiment, at least one additional cap base 502 is disposed along the central portion of the upper cap 400 to provide support thereto. The number of cap bases 500, 501, 502 can be adjusted to provide sufficient support based on the length of the entryway system 10. The use of separate cap bases 500, 501, 502 at intervals along the upper cap 400 provides a cap base 500 and upper cap 400 combination that is less expensive to produce relative to threshold cap 100 due to a reduction in the amount of material used. Some of the cap bases 500, 501 may be formed with an end wall 530 to support a side gasket 700 as discussed above. Other cap bases 502 may have the side wall omitted in order to allow the cap base 502 to support the central portion of the upper cap 400. In some embodiments, the cap base 500 is configured to house a biasing spring 451 configured to provide an additional upward biasing force to the rigid articulating top portion 402.

FIG. 27 shows a cross sectional view of FIG. 26 through the cap base 500, in combination with another embodiment of a door sweep 600. The upper cap 400 may be configured to interact with the door sweep 600 as shown in FIG. 27 or may alternatively interact with the door sweep 300 of FIG. 1. The upper cap 400 may include a rigid articulating top portion 402 capable of interacting with the door panel 200, a first embodiment of a door sweep 300 (see FIG. 1), or a second embodiment of a door sweep 600. The articulating top portion 402 may include a top wall 407 and a locking wall 408 extending substantially perpendicular to the top wall 407. The area of the articulating top portion 402 that is proximate to the intersection of the top wall 407 and the locking wall 408 forming the uppermost portion.

The upper cap 400 may include a front wall 406. At least a portion of the front wall 406 is configured to be substantially parallel, and disposed adjacent to the first channel wall 14 and decking dam 23. Extending outwardly and downwardly from near the top of the front wall 406 is a dam cover 430. The dam cover 430 and the front wall 406 combine to form a first slot 432. The first slot 432 is configured to accept the decking dam 23 therein, and for forming a sealing engagement therewith, to reduce or eliminate water intrusion between the decking dam 23 and the upper cap 400. Extending inwardly and downwardly from the front wall 406 is a substantially L-shaped projection 434. The L-shaped projection 434 includes a projection first leg 436 extending in the interior direction and a projection second leg 438 extending downwardly from the projection first leg 436, substantially parallel with the front wall 406. The projection second leg 438 may include one or more flexible barbs 440.

The rigid articulating top portion 402 extends from the inner surface of the front wall 406 at a position above the L-shaped projection 434. The articulating top portion 402, particularly top wall 407, connects to the front wall 406 with a resilient hinge 420. The hinge 420 provides the mechanism by which the top portion 402 is biased upwardly toward the door panel 200 or door sweep 300, 600. The hinge 420 may be a living hinge comprised of an area of reduced thickness of the same polymeric material as the top portion 402, the front wall 406, the l-shaped projection 434 and dam cover 430. In order to help the upward bias of the articulating top portion 402, an optional biasing spring 451 may be disposed under the articulating top portion 402.

Alternatively, the hinge 420 may be comprised of a separate resilient material disposed between the top wall 407 and the front wall 406 as shown in FIG. 27. The resilient material can be extruded and set to bias the articulating top portion 402 upwardly relative to the front wall 406. In a preferred embodiment, the resilient material can be co-extruded with the articulating top portion 402 and the front wall 406 to form the self-articulating upper cap 400. It should be noted that the hinge 420 of FIG. 25B can also apply to the self-articulating threshold cap 100 of FIGS. 1, 23 and 24. Providing the resilient material of the hinge 420 along the full length of the upper cap 400 is preferred. This is because the resilient material will be able to provide a biasing force across the entire length of the rigid articulating top portion 402. Some prior art caps have discrete springs spaced along the cap and providing discrete point forces to the cap. Application of only point forces means the prior art cap is less able to compensate for differences in spacing between the door panel and the cap, at locations between point force locations. As a result of using resilient material along the full length of the upper cap 400, the top portion 402 will have an increased ability to maintain a seal with the door sweep 600 even if the gap between the door bottom edge 201 and the threshold assembly 11 is inconsistent along the length of the upper cap 400.

As best seen in FIG. 27, each of the cap bases 500, 501 (see FIG. 26), 502 (see FIG. 26) is capable of being disposed within the sill channel 13 to reside on the floor 18 thereof. Each cap base 500, 501, 502 comprises a bottom wall 504 to be disposed along the floor 18 of the sill channel 13. Where the nosing strip 16 extends along the floor 18 of the sill channel 13, as shown in FIG. 1, the cap bases 500, 501, 502 can be set upon the nosing strip 16. The bottom wall 504 connects to a back wall 505 to be disposed adjacent to the nosing 15 or nosing strip 16.

Each cap base 500, 501, 502 defines a cavity 510 with an upward opening 511. For the embodiments shown, a portion of said opening 511 is covered by a stop wall 512. The cavity 510 of each cap base 500, 501, 502 is configured to accept the locking wall 408 of the upper cap 400. The locking wall 408 may further include a hook portion 412 configured to interact with the stop wall 512 to prevent the locking wall 408 from advancing upwardly therepast, thereby limiting the upward travel of the articulating top portion 402 of the upper cap 400.

The stop wall 512 acts as a vertical adjustment limiter for the rigid articulating top portion 402. Providing the stop wall 512 properly positions the top portion 402 when the door panel 200 is in the open position. If this vertical limiter were removed, the top portion 402 would relax to a height that would impede the ability to close the door panel 200 since the top portion 402 would likely strike the door panel 200, instead of first enacting with the door sweep 300, 600. If the top portion 402 alone had a relaxed position equal to the height of engagement with the stop wall 512, the relative biasing force applied to the top portion 402 would decrease, reducing the available sealing force between the upper cap 400 and the door sweep 300, 600.

Cap bases 500, 501, 502 can be provided with stop walls 512 disposed at various heights relative to the bottom wall 504. The stop walls 512 may be provided with various thicknesses to achieve the same result. These variations in the relative position of stop wall 512 of the cap base 500, 501, 502 allow for fine tuning the range of motion of the rigid articulating top portion 402 of the upper cap 400.

In one common situation, a door panel 200 may sag such that the gap between the door bottom and the entryway system 10 is smaller adjacent to the latch side of the door than the hinge side of the door. In this situation, the door can "stick" or become difficult to open and close due to contact with the entryway system 10. In order to reduce this resistance, the upper cap 400 would preferably have a decreased maximum height adjacent to latch side of the door. To provide the upper cap 400 with a decreased maximum height at the end adjacent the door latch while maintaining the full maximum height of the upper cap 400 at the opposite, hinged end, and thereby accommodating the difference in gap, the cap base 500 supporting the end of the upper cap 400 adjacent the door latch may be different from the cap base 501 supporting the opposite end of the upper cap 400. For example, with reference to FIG. 26, the cap base 500 on the left distal end may have a stop wall 512 that is relatively high or relatively thin to fill a standard margin at the hinge side of the door, while the cap base 501 on the right distal end may have a stop wall 512 that is relatively lower or thicker to fill a lower margin on the latch side of the door.

Each cap base 500, 501, 502 may further define a base channel 520 extending along the length thereof. The base channel 520 is configured to accept the second leg 438 of the upper cap 400. With the help of the flexible barbs 440 disposed on the second leg 438, the second leg 438 forms a friction fit within the base channel 520. Therefore, the at least one cap base 500 holds the front wall 406 of the upper cap 400 within the sill channel 13. To fit the upper cap 400 to the cap base 500, insert second leg 438 into base channel 520. Slide the cap base 500 relative to the upper cap 400 to position the cap base 500 in the proper location along the upper cap 400, then snap the locking wall 408 down past the stop wall 512.

An optional biasing spring 451, as shown in FIG. 26, can be disposed under the top wall 407 of the upper cap 400, and may be held in place by the cap bases 500, 501, 502.

Referring again to the side gaskets 700, best seen in FIG. 26, the side gaskets 700 can also be used in combination with any of the threshold caps 100 shown in FIGS. 1-6. The side gaskets 700 can be adhered to non-adjustable portions of the caps 100 or adhered to a door jamb or mullion disposed at the end of the entryway system 10. The side gaskets 700 may be those described in a co-pending application Ser. No. 13/761,709 filed Feb. 7, 2013 and having the same inventors as the instant disclosure. The co-pending application is incorporated herein by reference.

As shown in FIG. 27, the articulating upper cap 400 may interact with another exemplary embodiment of a door sweep 600. The door sweep 600 may be integral with or otherwise attached, secured or fixed to a bottom portion of the door panel 200. In some instances, the door panel 200 includes an underside or bottom edge 201 with the door sweep 600 flush thereagainst. According to some aspects, the door sweep 600 may include a support wall 603 secured to the bottom edge 201 of the door panel 200 and extending along the width thereof. In a preferred embodiment, the support wall 603 may be partially adhered to the door bottom using a strip of caulk applied along the exterior portion and longitudinal ends of the support wall 603.

A front flange 604, a resilient bulb 602, a first projection 605, and a second projection 610 depend from the support wall 603. The front flange 604 and resilient bulb 602 are preferably flexible, while projections 605, 610 are preferably rigid. In some instances, all four may be integrally formed with the support wall 603, by, for example, co-extrusion. While it is preferred that resilient bulb 602 be generally ovoid, other suitable shapes are possible. It should be understood that resilient bulb 602 extends the length of the door sweep 600, but since the cross-sectional shape is bulb-like, it is described as a bulb.

The front flange 604 may include a flexible seal fin 607 that fits between the door panel 200 and support wall 603 for sealing the joint between the door panel 200 and door sweep 600, thus preventing water penetration along the joint.

The first projection 605 can be configured to interact with the threshold cap 100 (FIG. 1) or upper cap 400 so as to force the articulating top portion 102, 402 thereof in a substantially downward direction (toward the floor 18 of the sill channel 13) as the door panel 200 is moved to the closed position. The first projection 605 may be constructed of any suitable material, such as, for example, a plastic material, and may be integrally formed with the support wall 603. The first projection 605 extends substantially the entire length of the door sweep 600 and is positioned adjacent to the front flange 604. The first projection 605 includes at least an inclined portion 608 extending downward and rearward relative to the support wall 603. In this regard, the inclined portion 608 may be a sloped configuration with respect to the support wall 603 such that the inclined portion 608 provides the initial contact between the door sweep 600 and the threshold cap 100 or upper cap 400 of the second embodiment of the self-articulating threshold cap 100. Upon contact, the top portion 102, 402 of the threshold cap 100, or upper cap 400 rides along the inclined portion 608. In other words, the inclined portion 608 acts as a ramp to force the top portion 102, 402 of the articulating threshold cap 100, or upper cap 400 downward. As the top portion 102, 402 moves past the end of the inclined portion 608, the top portion 102, 402 will re-adjust in an upward direction.

The second, preferably rigid, projection 610 is an arm extending downward and rearward relative to the support wall 603. The second projection 610 can extend substantially the entire length of the door sweep 600 and is disposed adjacent to an outward side of the resilient bulb 602. The second projection 610 is configured to interact with the top portion 102, 402 of the articulating threshold cap 100, or upper cap 400 thereof to properly position the top portion 102, 402 to be at the correct height for forming a seal with the resilient bulb 602.

The above descriptions of preferred embodiments of the disclosure are intended to illustrate various aspects and features of the invention without limitation. Persons of ordinary skill in the art will recognize that certain changes and modifications can be made to the described embodiments without departing from the scope of the invention. All such changes and modifications are intended to be within the scope of the appended claims. Features from one embodiment or aspect may be combined with features from any other embodiment or aspect in any appropriate combination. For example, any individual or collective features of method aspects or embodiments may be applied to apparatus, product or component aspects or embodiments and vice versa.

That which is claimed:

1. A threshold cap configured to be at least partially disposed between an upstanding nosing and an upstanding dam of a threshold, the threshold cap comprising:

a substantially vertical first wall;

an articulating portion having a first end portion supported by the first wall, the articulating portion extending from the first end portion to a second end portion, the second end portion being unsupported such that the articulating portion pivots about a pivot axis between a raised position and a lowered position, the pivot axis parallel to and offset from a central longitudinal axis of the threshold cap, the central longitudinal axis parallel to the first wall; and a biasing member formed separate from the first wall and the articulating portion, the biasing member biasing the articulating portion towards the raised position.

2. The threshold cap according to claim 1, a wherein the biasing member is disposed between the first wall and the articulating portion.

3. The threshold cap according to claim 1, wherein the first end portion of the articulating portion forms a hinge adjacent the first wall.

4. The threshold cap according to claim 1, further comprising a cap base configured to support the first wall.

5. The threshold cap according to claim 1, further comprising a locking wall extending downward from the second end portion of the articulating portion, the locking wall configured to limit an amount of pivot of the articulating portion towards the raised position.

6. A threshold comprising:

a substrate;

an upstanding nosing positioned along an edge of the substrate;

an upstanding dam positioned on the substrate and spaced-apart from the nosing to define a gap therebetween; and a threshold cap according to claim 1 at least partially disposed within the gap.

7. The threshold according to claim 6, wherein the first wall is adjacent the dam.

8. A door entryway system comprising:

a door panel;

a door sweep attached to a bottom of the door panel; and a threshold according to claim 6, the threshold cap of the threshold at least partially underlying the door panel when the door panel is in a closed position and configured to form a seal with the door sweep.

9. A threshold cap configured to be at least partially disposed between an upstanding nosing and an upstanding dam of a threshold, the threshold cap comprising:

a substantially vertical first wall;

an articulating portion having a first end portion supported by the first wall, the articulating portion extending from the first end portion to a second end portion, the second end portion being unsupported, the articulating portion movable between a first height and a second height, the second end portion moving a greater magnitude than the first end portion as the articulating portion moves between the first and second heights, the articulating portion being biased towards the first height, and a locking wall extending downward from the second end portion of the articulating portion, the locking wall configured to limit an amount of movement of the second end portion towards the first height.

10. The threshold cap according to claim 9, further comprising a biasing member disposed between the first wall and the articulating portion, the biasing member configured to bias the articulating portion towards a first height.

11. The threshold cap according to claim 9, wherein the first end portion of the articulating portion forms a hinge adjacent the first wall.

12. The threshold cap according to claim 9, further comprising a first cap base configured to support the first wall.

13. A threshold comprising:

a substrate;

an upstanding nosing positioned along an edge of the substrate;

an upstanding dam positioned on the substrate and spaced-apart from the nosing to define a gap therebetween; and a threshold cap according to claim 9 at least partially disposed within the gap.

14. The threshold according to claim 13, wherein the first wall is adjacent the dam.

15. A door entryway system comprising:

a door panel;

a door sweep attached to a bottom of the door panel; and a threshold according to claim 13, the threshold cap of the threshold at least partially underlying the door panel when the door panel is in a closed position and configured to form a seal with the door sweep.

16. A threshold cap configured to be at least partially disposed between an upstanding nosing and an upstanding dam of a threshold, the threshold cap comprising:

a substantially vertical first wall;

an articulating portion having a first end portion supported adjacent the first wall, the articulating portion extending from the first end portion to a second end portion, the second end portion being unsupported, the articulating portion movable between a first height and a second height, the second end portion moving a greater magnitude than the first end portion as the articulating portion moves between the first and second heights; and a biasing member formed separate from the first wall and the articulating portion, the biasing member biasing the articulating portion towards the first height.

17. A threshold comprising:

a substrate;

an upstanding nosing positioned along an edge of the substrate;

an upstanding dam positioned on the substrate and spaced-apart from the nosing to define a gap therebetween; and a threshold cap according to claim 16 at least partially disposed within the gap.

18. The threshold according to claim 17, wherein the first wall is adjacent the dam.

19. A door entryway system comprising:

a door panel;

a door sweep attached to a bottom of the door panel; and a threshold according to claim 17, the threshold cap of the threshold at least partially underlying the door panel when the door panel is in a closed position and configured to form a seal with the door sweep.

* * * * *